United States Patent [19]

Tamaki et al.

[11] Patent Number: 4,888,262

[45] Date of Patent: Dec. 19, 1989

[54] IMAGE FORMING METHOD

[75] Inventors: Kiyoshi Tamaki; Koichi Kudoh; Yoshihiko Etoh; Yoshiaki Takei, all of Hachioji, Japan

[73] Assignee: Konica Corporation, Tokyo, Japan

[21] Appl. No.: 180,973

[22] PCT Filed: Jul. 9, 1987

[86] PCT No.: PCT/JP87/00490

§ 371 Date: Apr. 21, 1988

§ 102(e) Date: Apr. 21, 1988

[87] PCT Pub. No.: WO88/00726

PCT Pub. Date: Jan. 28, 1988

[30] Foreign Application Priority Data

Jul. 10, 1986 [JP] Japan ..... 61-162864
Jul. 10, 1986 [JP] Japan ..... 61-162865
Sep. 29, 1986 [JP] Japan ..... 61-233054

[51] Int. Cl.[4] ..... G03G 5/14

[52] U.S. Cl. ..... 430/58; 430/59; 430/66; 430/67

[58] Field of Search ..... 430/58, 59, 66, 67

[56] References Cited

U.S. PATENT DOCUMENTS 4,563,408 1/1986 Lin et al. ..... 430/59
4,599,286 7/1986 Limburg et al. ..... 430/59
4,741,981 5/1988 Hashimoto et al. ..... 430/59 X

FOREIGN PATENT DOCUMENTS 56-128950 10/1981 Japan ..... 430/66
57-122444 7/1982 Japan ..... 430/58
59-136744 8/1984 Japan ..... 430/67

*Primary Examiner*—Roland E. Martin
*Attorney, Agent, or Firm*—Jordan B. Bierman

[57] ABSTRACT

An image forming method which employs an electrophotographic photoreceptor having high sensitivity, high resistance to damage, high durability, and high resistance to ozone oxidation. The method comprises charging the surface of the photoreceptor with positive charge, the photoreceptor including a photoconductive base, a photoreceptive layer formed on the base and consisting of at least a layer having a charge transport function and a layer having a charge generating function, and a resin-containing non-photoreceptive layer formed on the photoreceptive layer as required, and in which one layer placed above the layer having a charge transport function contains an antioxidizing agent, forming an electrostatic latent image on the surface of the photoreceptor by image-like exposure, then developing the electrostatic latent image.

15 Claims, 1 Drawing Sheet

IMAGE FORMING METHOD

TECHNICAL FIELD

The present invention relates to an electro photographic image forming method and, more particularly, to an image forming method in which a positive charging photoreceptor is employed.

BACKGROUND ART

Hitherto, as a typical electro photographic photoreceptor for image forming purposes, a photoreceptor, for example, of the type having a photoreceptive layer containing inorganic photoconductive materials, such as selenium, zinc oxide, and cadmium sulfide, has been widely used.

Recently, various research and development efforts have been actively made for utilization of various kinds of organic photoconductive materials as materials for a photoreceptive layer of an electro-photographic photoreceptor.

For example, in Japanese Patent Publication No. 10496/1975 there is described an organic photoreceptor having a photoreceptive layer containing poly-N-vinylcarbazole and 2,4,7-trinitro-9-fluorenone. However, this photoreceptor is not very satisfactory in respect of sensitivity and durability. In order to overcome such deficiencies, attempts are being made to develop an organic photoreceptor having a photoreceptive layer in which charge generating and change transporting functions are separately pereformed by different materials, whereby high sensitivity and high durability requirements can be met.

In such electro-photographic photoreceptor of the so-called function partition type, materials capable of individually pereforming different functions can be selected from a wide range of groups of materials, and therefore an electrophotographic photoreceptor having any desired characteristics can be fabricated comparatively easily.

A large number of materials have hitherto been proposed as charge generating materials effective for use in such function partition type photoreceptor. For use of an inorganic material as such, in Japanese Patent Publication No. 16198/1968, for example, there is described the use of amorphous selenium, which material is used in combination with an organic charge transporting material.

Varieties of electro-photographic photoreceptors in which organic dyes or organic pigments are used as charge generating materials have also been proposed; for example, those having a photoreceptive layer containing a bisazo compound are already known through Japanese Provisional Patent Publication Nos. 37543/1972, 22834/1980, 79632/1979, and 116040/1981.

Now, the prior-art photoreceptors using aforesaid organic photoconductive materials are generally used as such for negative charging. The reason for this is that greater Hall mobility of charge is available in the case of negative charging, which fact is advantageous in respect of photosensitivity and otherwise. However, it has been found that the use of such negative charging photoreceptor involves the following problems.

One problem is that ozone is likely to be generated in the atmosphere in the course of negative charging by an electrifier, which will affect the environmental conditions. Another problem is that the development of a negative charging photoreceptor requires positive polarity toners, which are difficult to manufacture in view of the sequence of their triboelectric effect in relation to charge particles of ferromagnetic substances.

In view of these problems, it has been proposed to employ a photoreceptor using organic photoconductive materials, as such for positive charging. For example, when a charge transport layer is laid on a charge generating layer in forming a photoreceptor, the use of a material having a large electron transfer capability, such as trinitrofluorenone, for the charge transport layer has been proposed in order to efficiently nullify the positive charge on the surface of the photoreceptor. However, the use of such material is very unsuitable from the standpoint of pollution control, because the material is carcinogenic.

Another type of positive charging photoreceptor is disclosed in the specification of U.S. Pat. No. 3,615,414, which is such that thiapyrilium salt (a charge generating material) is used in combination with polycarbonate (a binder resin) so as to allow it to combine with the latter to form a eutectic complex. However, the use of this known type of photoreceptor involves considerable memory phenomenon. Another difficulty is that a ghost image is likely to occur. A photoreceptor in which phthalocyanine is used is disclosed in the specification of U.S. Pat. No. 3,357,989. However, phthalocyanine is liable to changes in its characteristics depending upon its crystalline form, which requires strict control of the crystalline form. In addition, this photoreceptor involves considerable memory phenomenon. Furthermore, its short wave sensitivity is low; therefore, the photoreceptor is considered unsuitable for use in copying machines which depend for its source of light upon visible light rays including short wave light.

As above noted, various attempts have been made in order to provide positive charging photoreceptors, but all the photoreceptors proposed so far involve problems yet to be solved in various respects, such as photosensitivity, memory, and/or pollution control.

In view of these difficulties, it is conceivable to employ for positive charging a photoreceptor having a lamination structure photoreceptive layer consisting of a charge generating layer containing a charge generating material which generates holes and electrons during illumination, as an upper layer (surface layer), and a charge transport layer containing a charge transporting material which has a hole transfer function, as a lower layer. It is also considered possible to employ for positive charging a photoreceptor having a photoreceptive layer of single-layer construction containing both of the charge generating and charge transporting materials.

In such photoreceptor for positive charging, if a charge generating material which has, for example, an electron attracting group in its molecular structure is used, it is considered that electron movement to nullify the positive charge on the surface of the photoreceptor is accelerated, it being thus possible to obtain high sensitivity characteristics.

However, in such positive charging photoreceptor, the layer containing the charge generating materials is formed as a surface layer, and accordingly the charge generating material, which is sensitive to light illumination, corona discharge, humidity, and more particularly to such external action as mechanical friction, is present in the vicinity of the surface layer; this may result in deterioration in the electro-photographic performance characteristics of the photoreceptor in the course of storage and image formation, which naturally means lower image quality.

In conventional negative charging photoreceptors having a charge transport layer as a surface layer, the charge generating layer is little liable to the influence of any such external action, and the charge transport layer serves to protect the lower layer, that is, the charge generating layer.

Contrary to this, in the case of positive charging photoreceptors, the surface layer which contains a charge generating material is subject to mechanical wear and damage due to external action and more particularly to developing and cleaning, with the result of various image defects, such as white spots and white lines, and also deterioration in electro-photographic performance characteristics, such as surface potential, sensitivity, memory, and residual potential.

Then, it may be conceivable to provide, for example, a thin protection layer comprised of a transparent insulating resin material to reinforce the layer containing the charge generating material, but in this case the trouble is that the charge generated during light illumination is blocked by the protective layer, with the result that the photoconductivity of the photoreceptor layer is lost.

It may also be conceivable to improve the resistance to wear and damage of the charge generating layer by increasing the thickness of the layer, but the trouble in this case is that the increased thickness leads to decreased sensitivity.

Therefore, the object of the invention is to provide an image forming method employing an electro-photographic photoreceptor which is advantageously constructed for positive charging purposes using organic photoconductive materials and which has high resistance to damage, high sensitivity, high degree of durability, and high resistance to ozone oxidation.

DISCLOSURE OF THE INVENTION

The present invention provides an image forming method comprising charging with positive charge the surface of an electro-photographic photoreceptor which has a photoconductive base, a photoreceptive layer formed on said base and consisting of at least a layer having a charge transport function and a layer having a charge generating function, and a protection layer formed on said photoreceptive layer as required, and in which one layer placed above said layer having a charge transport function contains an antioxidizing agent, forming an electrostatic latent image on said surface by image-like exposure, then developing said electrostatic latent image, thereby forming a visible image.

1 . . . base;
2 . . . charge transport layer (hereinafter referred to as CTL);
3 . . . charge generating layer (hereinafter referred to as CGL);
4 . . . photoreceptive layer;
5 . . . charge transport material (hereinafter referred to as CTM);
6 . . . charge generating material (hereinafter referred to as CGM); and
7 . . . protection layer (hereinafter referred to as OCL).

DETAILED DESCRIPTION OF THE INVENTION

In the present invention, a layer having a charge generating function specifically means a layer containing CGM, and a layer having a charge transport function specifically means a layer containing CTM. Therefore, a layer containing both CTM and CGM may be taken as a layer having a charge generating function and concurrently as a layer having a charge transporting function. It is also noted that in the present invention, a layer placed above the layer having a charge transport function means a layer which is positioned above at least one layer containing CTM; if the photoreceptor has two or more layers containing CTM, there should be at least one layer containing CTM below the layer containing antioxidizing agent, that is, at the base side.

Figure 1:
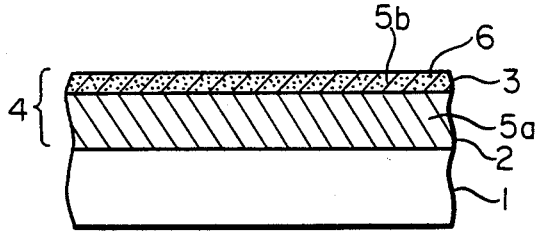
FIGS. 1 through 3, inclusive, are sectional views showing, by way of example, positive charging photoreceptors which can be advantageously employed in the practice of the invention, wherein the following numerals respectively designate the following.
Figure 2:
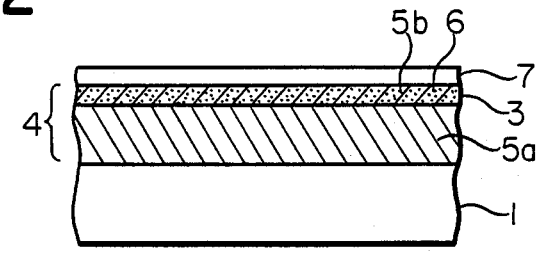

The photoreceptor employed in the practice of the invention is typically one having a charge transport layer (CTL) containing a charge transporting material (CTM) and a charge generating layer (CGL) containing a charge generating material (CGM), laminated in that order on a photoconductive base, but according to one preferred embodiment of the invention, as FIG. 1 shows, the charge generating layer (CGL) 3 may be one containing the charge generating material (CGM) 6 and the charge transport material (CTM) concurrently. According to another embodiment of the invention, as FIG. 2 shows, the photoreceptor may have a protection layer (OCL) 7 comprised principally of a binder resin which is formed on a photoreceptive layer 4 consisting of CTL2 and CGL3. Further, there may be provided an intermediate layer between the photoconductive base and the photoreceptive layer as required.

Figure 3:
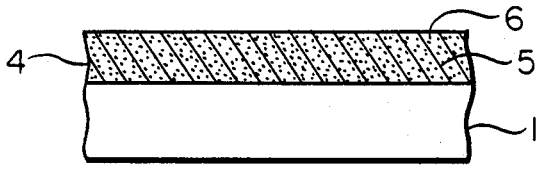

According to the invention, the antioxidizing agent is loaded in a layer laid above the charge transport layer (CTL), and more specifically it is loaded in the charge generating layer (CGL) and/or the protection layer (OCL) if the photoreceptive layer 4 consists of two separate layers, namely, the CTM containing charge transport layer and the CGM containing charge generating layer. If the photoreceptive layer consists of a single layer containing both CTM and CGM, as FIG. 3 shows, the antioxidizing agent is loaded in a non-photosensitive layer, for example, the protection layer (OCL) positioned above the photoreceptive layer.

Antioxidizing agents which can be advantageously used in the practice of the invention embrace the following groups of compounds:

group (I): hindered phenolics;
group (II): paraphenylenediamines;
group (III): hydroquinones;
group (IV): organic sulfur compounds;
group (V): organic phosphorous compounds;
group (VI): chromans; and
group (VII): coumarins.

The charge generating layer should preferably contain a charge transporting material, and where the thickness of the charge generating layer is $2 \sim 7$ $\mu$m, the effect of the invention will be greater. As already mentioned with reference to the prior art, in a positive charging photoreceptor using an organic photoconductive material, the charge generating layer constitutes the surface layer, and therefore it is less resistant to damage. As such, if the photoreceptor is to have improved durability, it is necessary that the thickness of the CGL should be made greater.

However, a thicker CGL results in decreased sensitivity. As a preventive means against such decreased sensitivity, it is possible to load a charge transporting material (hereinafter sometimes referred to as CTM) in the CGL, but since CTM, in its structure, is more liable to ozone oxidation as compared with a charge generating material (hereinafter sometimes referred to as CGM), it may become easily deteriorated by action of ozone, the durability of the photoreceptor being thus easily lost.

Typical examples of the antioxidizing agents which can be advantageously in the practice of the invention will be given below, but the scope of the agents is not limited to the examples.

Group (I): hindered phenolics dibutyl hydroxytoluene, 2,2'-methylene bis(6-t-butyl-4-methylphenol), 4,4'-butylidene bis(6-t-butyl-3-methylphenol), 4,4'-thiobis(6-t-butyl-3-methylphenol), 4,4'-thiobis(6-t-butyl-3-methylphenol), 2,2'-butylidene bis(6-butyl-4-methylphenol), α-tocopherol, β-tocopherol, 2,2',4-trimethyl-6-hydroxy-7-butylchroman, pentaerythrityl tetrakis[3-(3,5-di-t-butyl-4-hydroxyphenol)-propionate] 2,2'-thiodiethylene bis[3-(3,5-di-t-butyl-4-hydroxyphenyl)propionate], 1,6-hexanediol bis[3-(3,5-di-t-butyl-4-hydroxyphenyl)propionate], butylhydroxyanisol, and dibutylhydroxyanisol.

Group (II): paraphenylenediamines

N-phenyl-N'-isopropyl-p-phenylenediamine, N,N'-di-sec-butyl-p-phenylenediamine, N-phenyl-N-sec-butyl-p-phenylenediamine, N,N'-diisopropyl-p-phenylenediamine, and N,N'-dimethyl-N,N'-di-t-butyl-p-phenylenediamine.

Group (III): hydroquinones 2,5-di-t-octylhydroquinone, 2,6-didodecyl hydroquinone, 2-dodecyl hydroquinone, 2-dodecyl-5-chlorohydroquinone, 2-t-octyl-5-methyl hydroquinone, and 2-(2-octadecenyl)-5-methyl hydroquinone.

Group (IV): organic sulfur compounds dilauryl-3,3'-thiodipropionate, distearyl-3,3'-thiodipropionate, distearyl-3,3'-thiopropionate, ditetradecyl-3,3'-thiopropionate, and ditetradecyl-3,3'-thiodipropionate.

Group (V): organic phosphorous compounds triphenylphosphine, tri(nonylphenyl)phosphine, tri(dinonyl phenyl)phosphine, tricresylphosphine, and tri(2,4-dibutyl phenoxy)phosphine.

These compounds are known as antioxidizing agents for rubber, plastics, and oils and fats, and are readily commercially available.

Groups (VI) and (VII)

Chromans and coumarins and expressed by the following general formula [I]:

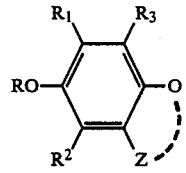

in which R represents an alkyl, an alkenyl, a cycloalkyl, an aryl, or a heterocyclic group; $R_1$, $R_2$, and $R_3$ represent hydrogen or halogen atoms, or alkyl, cycloalkyl, alkoxy, alkylthio, aryl, aryloxy, arylthio, acyl, acylamino, diacylamino, acyloxy, alkylamino, fulfonamide, or alkoxy groups; and Z represents a group of atoms necessary for forming a chroman or coumarin ring. Further, R and $R_1$ may be cyclized to form a chroman or coumarin ring, and such chroman or cooumarin ring may have a substituent group.

The compounds useful in the practice of the invention which are expressed by the foregoing general formula [I] embrace chromans having an alkoxy, an alkenoxy, a cycloalkyloxy, or a heterocyclic oxy group at 6-position, and coumarins having an alkoxy, an alkenoxy, a cycloalkyloxy, or a heterocyclic oxy group at 5-position, and they may be expressed by the following general formulas [II], [III], and [IV].

General formula [II]:

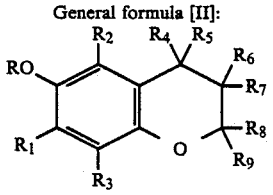

General formula [III]:

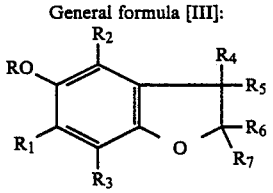

General formula [IV]:

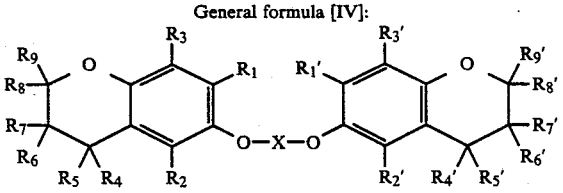

In general formulas [II] and [III], R, $R_1$, $R_2$, and $R_3$ respectively have same meanings as R, $R_1$, $R_2$, and $R_3$ in general formula [I]; and $R_4$, $R_5$, $R_6$, $R_7$, and $R_8$ represent hydrogen or halogen atoms, or alkyl, alkoxy, alkylthio, alkenyl, alkenoxy, aryl, aryloxy, N-substituted amino, or heterocyclic groups. Further, $R_8$, and $R_9$ may be cyclized to form a carbon ring together, and such carbon ring may be substituted by alkyl groups. In general formula [IV], $R_1 \sim R_9$ respectively have same meanings as $R_1 \sim R_9$ in general formulas [II] and [III], and $R_1' \sim R_9'$ respectively have same meanings as $R_1 \sim R_9$.

Symbol X represents an alkylene, a phenylene, a cycloalkylene, or a bivalent heterocyclic group with which a carbon chain of an alkylene group may combine through —O—, —S—, —NH—, or —$SO_2$—.

In general formulas [II] and [III], it is especially preferable that R is a substituted or unsubstituted alkyl or cycloalkyl group, $R_1$, $R_2$, and $R_3$ are hydrogen atoms, or alkyl or cycloalkyl groups, and $R_4 \sim R_9$ are hydrogen or halogen atoms, or alkyl or cycloalkyl groups, and that R and $R_1$ constitute a group of atoms necessary for forming a chroman ring together through their cyclization, and $R_8$ and $R_9$ constituted a group of atoms necessary for forming a carbon ring together through their cyclization.

In general formulas [V], it is especially preferable that $R_1$, $R_1'$, $R_4$, $R_4'$, $R_8$, $R_8'$, $R_9$, and $R_9'$ are alkyl groups; $R_2$, $R_2'$, $R_3$, $R_3'$, $R_5$, $R_5'$, $R_6$, $R_6'$, $R_7$, and $R_7'$ are hydrogen atoms; and X is an alkylene group with which an alkylene group or a carbon chain of an alkylene group is in bond through $—SO_2—$.

Typical examples of the compounds which are advantageously employed in the practice of the invention are shown below, but it is understood that the scope of the compounds is not limited to the examples.

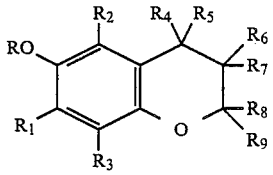

| | R | $R_1$ | $R_2$ | $R_3$ | $R_4 \sim R_9$ |
|---|---|---|---|---|---|
| 1 | $C_3H_7$ | (t)$C_8H_{17}$ | H | H | $R_4,R_6,R_9$:$CH_3$ $R_8$:$C_2H_5$ |
| 2 | $CH_3$ | $CH_3O$ | H | H | $R_8$:$CH_3$ |
| 3 | 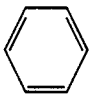 | H | H | H | $R_4,R_8,R_9$:$CH_3$ |
| 4 | $CH_3$ | $CH_3$ | H | $CH_3$ | $R_8,R_9$:$CH_3$ |
| 5 | $KOOCCH_2$ | (t)$C_4H_9$ | H | H | $R_4,R_8,R_9$:$CH_3$ |
| 6 | $C_8H_{17}OOCCH_2CH_2$ | H | H | H | $R_4$:(i)$C_3H_7$ $R_8,R_9$:$CH_3$ |
| 7 | 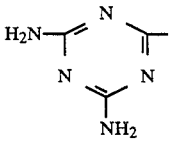 | $CH_3$ | H | H | $R_4,R_8,R_9$:$CH_3$ |
| 10 | $C_2H_5$ | $C_{18}H_{37}$ | H | H | 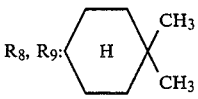 |
| 11 | $CH_3$ | H | H | H | $R_4,R_6$:Cl $R_8,R_9$:$CH_3$ |
| 12 | $(CH_3)_2NCH_2CH(OH)CH_2$ | $CH_3$ | $CH_3$ | $CH_3$ | $R_8$:$CH_3$ |
| 13 | 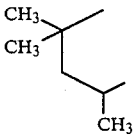 | | H | H | $R_4,R_8,R_9$:$CH_3$ |

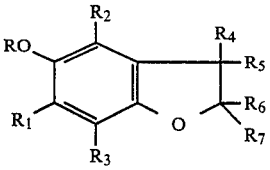

| | R | $R_1$ | $R_2$ | $R_3$ | $R_4 \sim R_7$ |
|---|---|---|---|---|---|
| 8 | $CH_3$ | $CH_3$ | H | H | $R_4,R_5$:$CH_3$ $R_8$:$C_2H_5O$ |
| 9 | $CH_3$ | (t)$C_8H_{17}$ | H | H | $R_4,R_5$:$CH_3$ $R_8$: 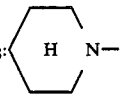 |

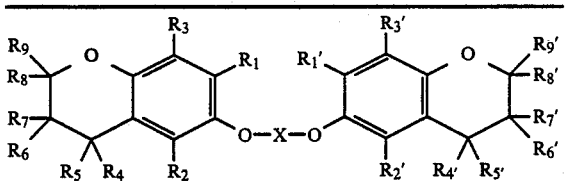

| X | $R_1 \sim R_{9'}$ |
|---|---|
| 14 $(CH_2)_6$ | $R_1,R_{1'},R_8,R_{8'},R_9,R_{9'}:CH_3$ $R_4,R_{4'}:(i)C_3H_7$ |
| 15 $CH_2CH_2SO_2CH_2CH_2$ | $R_1,R_{1'},R_4,R_{4'},R_8,R_{8'},R_9,R_{9'}:CH_3$ |

These compounds can be synthesized by causing a halide, a sulfate, or a vinyl compound to react, in the presence of alkalis and according to a conventional alkylation method, with 6 hydroxy chromans or 5 hydroxy chromans obtained in such manner as described in U.S. Pat. Nos. 3,432,300, 3,537,050, and 3,574,627, and Japanese Patent Publication No. 20977/1974, or by combining phenolics having an other linkage at p position to those chromans according to such methods as described in West German Pat. No. 1,938,672, Journal of the American Chemical Society, Vol 66, pp 1523~1525, Journal of the Chemical Society, pp 1850~1852 (1958), and the latter mentioned journal, pp 3350~3378 (1959).

The amount of such compound is, when loaded in CGL, 0.1 to 100 wt %, preferably 1 to 50 wt %, and especially preferably 5 to 25 wt %, relative to the weight of CTM in the OGL, and when loaded in OCL, 0.1 to 100 wt %, preferably 1 to 50 wt %, relative to the weight of the binder resin in the OCL.

The charge generating materials suitable for use in the practice of the invention embrace both inorganic pigments and organic dyes, if they are capable of absorbing visible light rays to generate free charges. Examples of inorganic pigments are amorphous selenium, trigonal-system selenium, selenium-arsenic alloys, selenium-tellurium alloys, cadmium salfide, cadmium selenide, cadmium sulfoselenide, mercury sulfide, lead oxide, and lead sulfide. In addition to these inorganic pigments, such organic pigments are exemplified below may be used.

(1) Azo pigments, such as monoazo pigments, polyazo pigments, metal complex azo pigments, pyrazolone azo pigments, stilbene azo and thiazole azo pigments.
(2) Perylene pigments, such as perylene anhydride and perylene imide.
(3) Anthraquinone or polycyclic quinone pigments, such as anthraquinone derivatives, anthanthrone derivative, dinenzopylene quinone derivatives, pyranthrone derivatives, violanthrone derivatives, and isoviolanthrone derivatives.
(4) Indigoid pigments, such as indigo derivatives and thioindigo derivatives.
(5) Phthalacyanine pigments, such as metallic and nonmetallic phthalocyanines.
(6) Carbonium pigments, such as diphenyl methane, triphenyl methane, xanthene, and acrydine pigments.
(7) Quinoneimine pigments, such as azine, oxazine, and thiazine pigments.
(8) Methine pigments, such as cyanine and azomethine pigments.
(9) Quinoline pigments.
(10) Nitro pigments.
(11) Nitroso pigments.
(12) Benzoquinone and naphthoquinone pigments.
(13) Naphthalimide pigments.
(14) Perynone pigments, such as bisbenzimidazole derivatives.

Various types of azo pigments having electron attracting groups are used because of their excellent electro-photographic characteristics, such as sensitivity, memory phenomenon, and residual potential, but polycyclic quinone pigments are most preferred from the standpoint of ozone resistance.

The reason for this may be that whereas azo groups are susceptible to ozone oxidation and accordingly are liable to deterioration in their electro-photographic characteristics, polycyclic quinones are inactive to ozone, though no detailed data is available which can prove this.

Illustrative of the azo pigments useful for the purpose of the invention are those shown below as exemplary compound groups [I]~[V].

Exemplary compound group [I]:
X'—N=N—A'—N=N—X'

| Compound No. | —A— | —X' |
|---|---|---|
| I-1 | 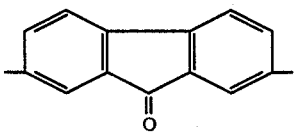 | 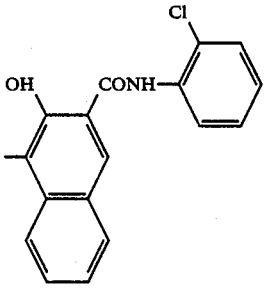 |

-continued
Exemplary compound group [I]:
X'—N=N—A'—N=N—X'
| Compound No. | —A— | —X' |
|---|---|---|
| I-2 | " | 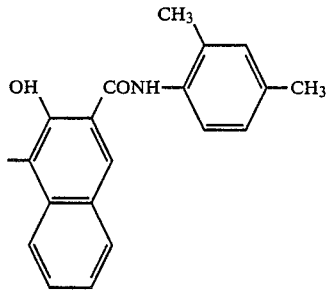 |
| I-3 | 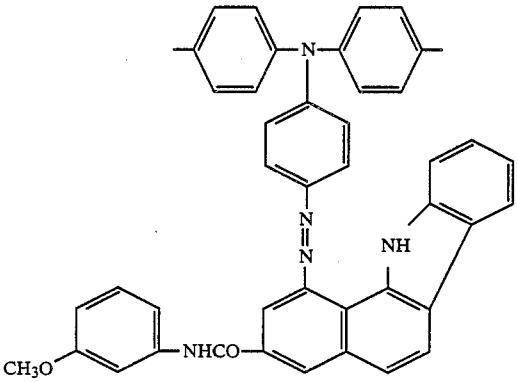 | 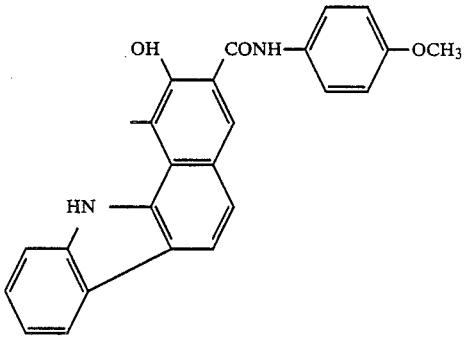 |
| I-4 | 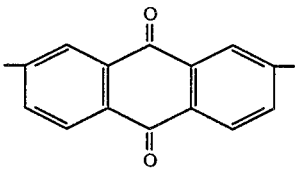 | 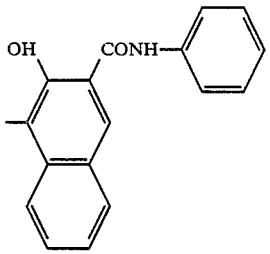 |
| I-5 | 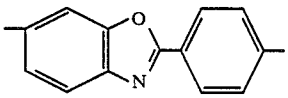 | 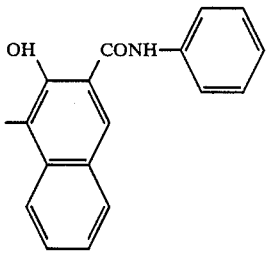 |
| I-6 | 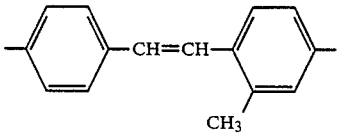 | " |

-continued
Exemplary compound group [I]:
X'—N=N—A'—N=N—X'
| Compound No. | —A— | —X' |
|---|---|---|
| I-7 | 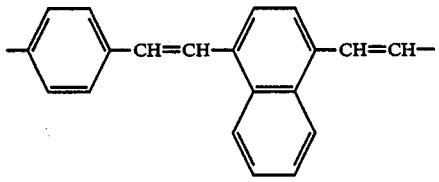 | " |
| I-8 | 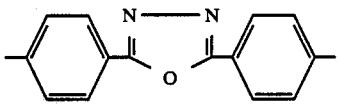 | 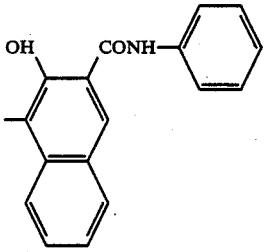 |
Exemplary compound group [II]:
$X^2$—N=N—$A^2$—N=N—$A^3$—N=N—$X^3$
| Compound No. | —$A^2$— | —$A^3$— | —$X^2$, —$X^3$ |
|---|---|---|---|
| II-1 | 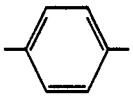 | 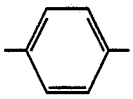 | 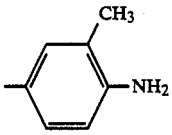 |
| II-2 | " | " | 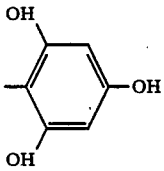 |
| II-3 | " | " | 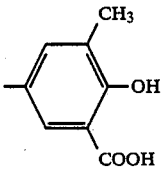 |
| II-4 | " | " | 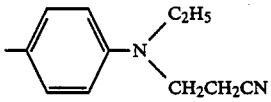 |
| II-5 | " | " | 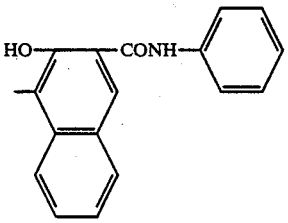 |

-continued
| Compound No. | Exemplary compound group [II]: $X^2—N=N—A^2—N=N—A^3—N=N—X^3$ | | |
|---|---|---|---|
| | $—A^2—$ | $—A^3—$ | $—X^2, —X^3$ |
| II-6 | " | " | 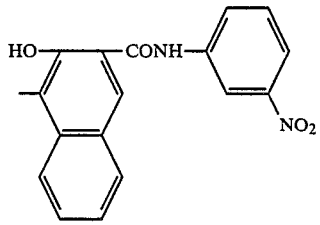 |
| II-7 | " | " | 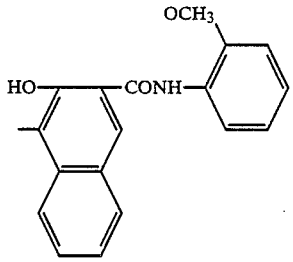 |
| II-8 | 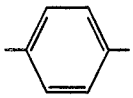 | 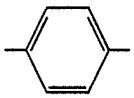 | 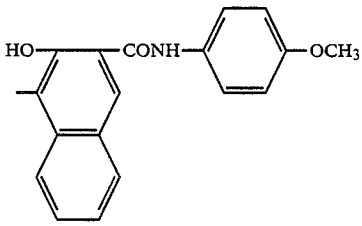 |
| II-9 | " | " | 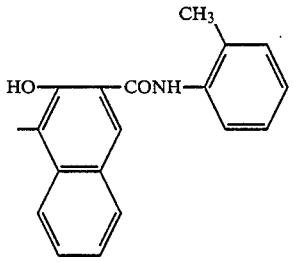 |
| II-10 | " | " | 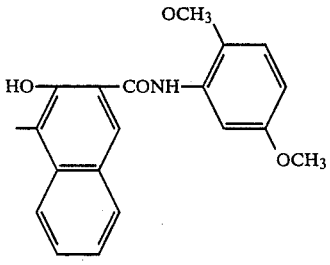 |
| II-11 | " | " | 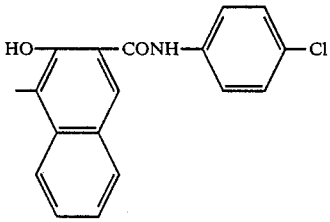 |

-continued
| Compound No. | Exemplary compound group [II]: $X^2—N=N—A^2—N=N—A^3—N=N—X^3$ | | |
|---|---|---|---|
| | $—A^2—$ | $—A^3—$ | $—X^2, —X^3$ |
| II-12 | " | " | 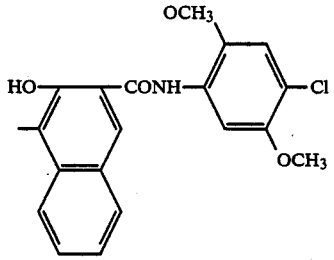 |
| II-13 | 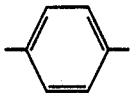 | 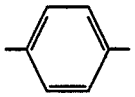 | 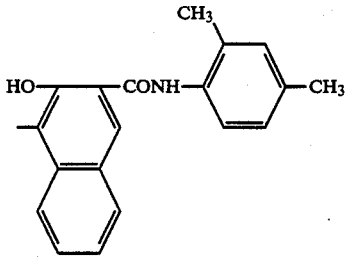 |
| II-14 | " | " | 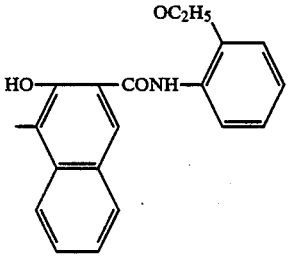 |
| II-15 | " | " | 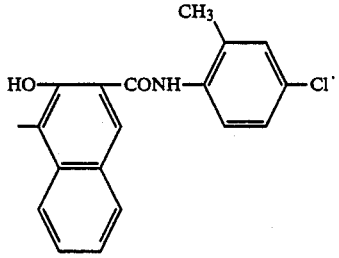 |
| | | | $(—X^2)$ 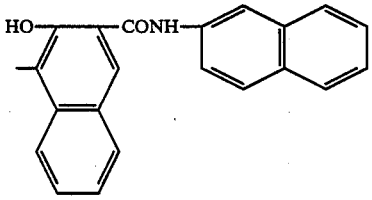 |
| II-16 | " | " | $(—X^3)$ 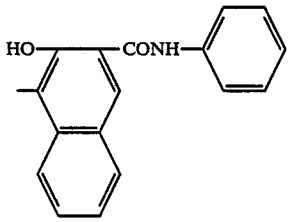 |

-continued
Exemplary compound group [II]:
$X^2—N=N—A^2—N=N—A^3—N=N—X^3$
| Compound No. | $—A^2—$ | $—A^3—$ | $—X^2, —X^3$ |
|---|---|---|---|
| II-17 | 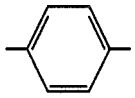 | 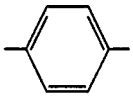 | 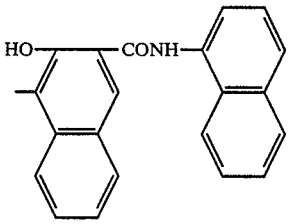 |
| II-18 | " | " | 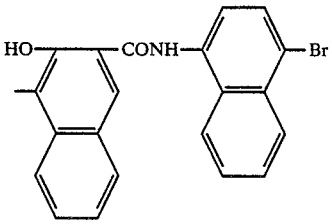 |
| II-19 | " | " | 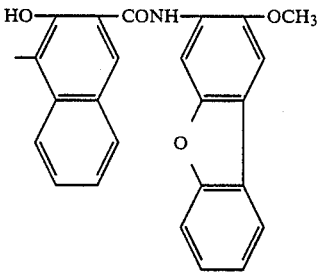 |
| II-20 | " | " | 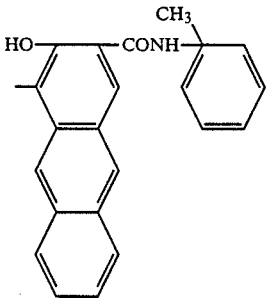 |
| II-21 | " | " | 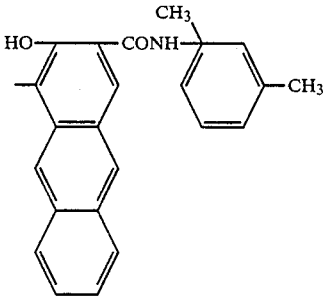 |

-continued
Exemplary compound group [II]:
$X^2—N=N—A^2—N=N—A^3—N=N—X^3$
| Compound No. | $—A^2—$ | $—A^3—$ | $—X^2$, $—X^3$ |
|---|---|---|---|
| II-22 | 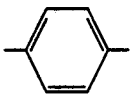 | 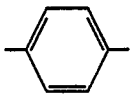 | 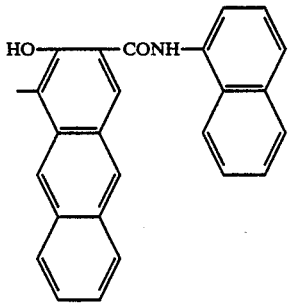 |
| II-23 | " | " | 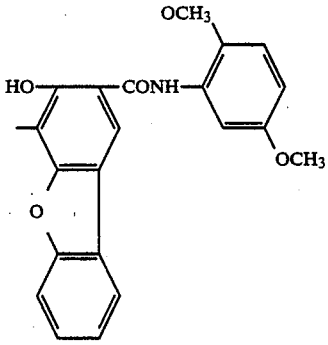 |
| II-24 | " | " | 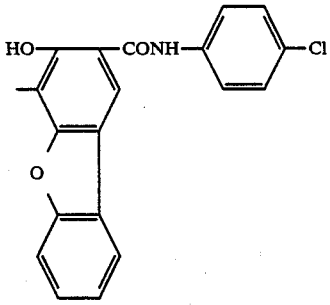 |
| II-25 | " | " | 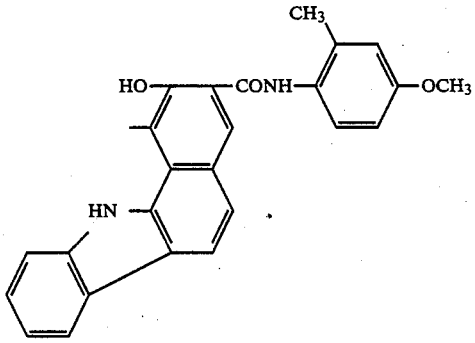 |

-continued
| Compound No. | Exemplary compound group [II]: $X^2-N=N-A^2-N=N-A^3-N=N-X^3$ | | |
|---|---|---|---|
| | $-A^2-$ | $-A^3-$ | $-X^2$, $-X^3$ |
| II-26 | " | " | 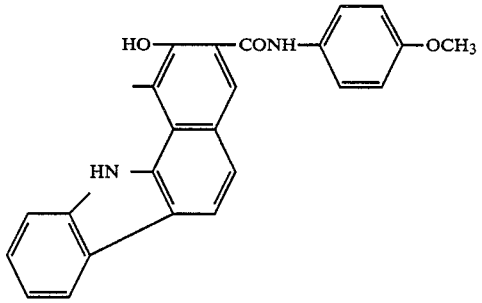 |
| II-27 | 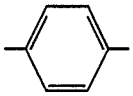 | 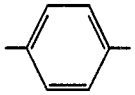 | 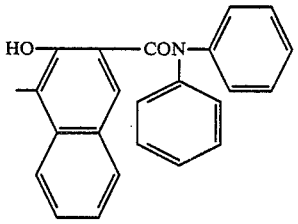 |
| II-28 | " | " | 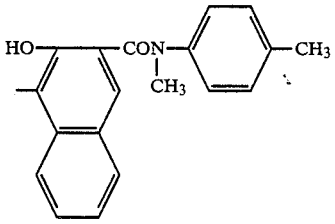 |
| II-29 | " | " | 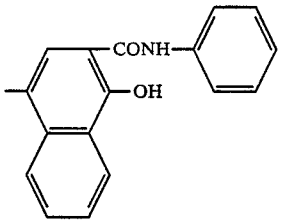 |
| II-30 | " | " | 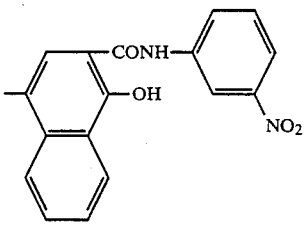 |
| II-31 | " | " | 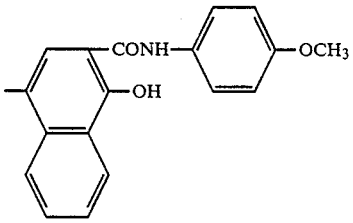 |

-continued
Exemplary compound group [II]:
$X^2—N=N—A^2—N=N—A^3—N=N—X^3$
| Compound No. | $—A^2—$ | $—A^3—$ | $—X^2, —X^3$ |
|---|---|---|---|
| II-32 | 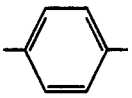 | 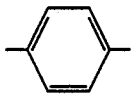 | 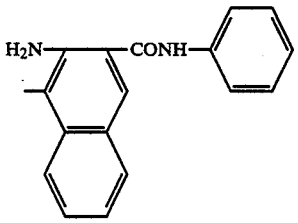 |
| II-33 | " | " | 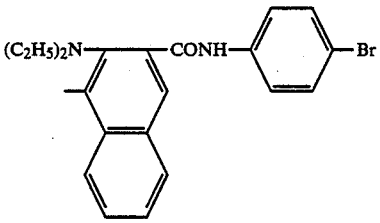 |
| II-34 | " | " | 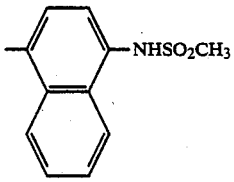 |
| II-35 | " | " | 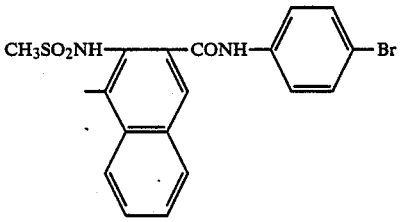 |
| II-36 | " | " | 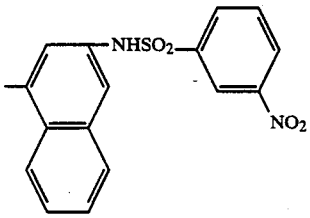 |
| II-37 | 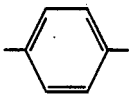 | 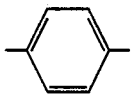 | 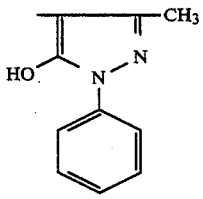 |

-continued
Exemplary compound group [II]:
$X^2—N=N—A^2—N=N—A^3—N=N—X^3$
| Compound No. | $—A^2—$ | $—A^3—$ | $—X^2, —X^3$ |
|---|---|---|---|
| II-38 | " | " | 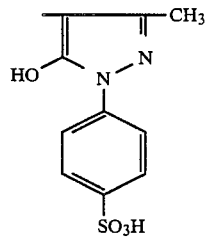 |
| II-39 | " | " | 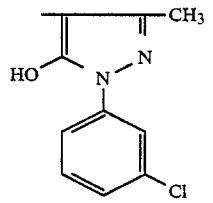 |
| II-40 | " | " | 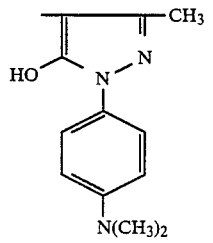 |
| II-41 | " | " | 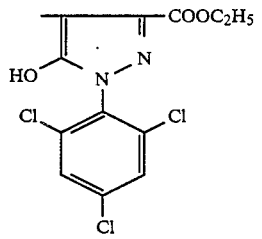 |
| II-42 | 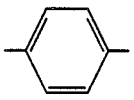 | 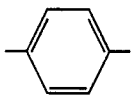 | 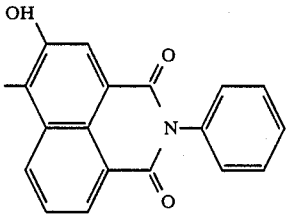 |
| II-43 | " | " | 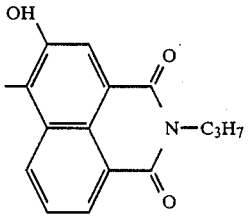 |

-continued
| Compound No. | Exemplary compound group [II]: $X^2—N=N—A^2—N=N—A^3—N=N—X^3$ | | |
|---|---|---|---|
| | $—A^2—$ | $—A^3—$ | $—X^2, —X^3$ |
| II-44 | " | " | 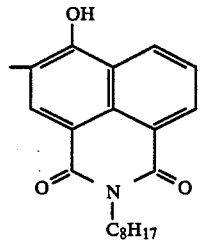 |
| II-45 | " | " | 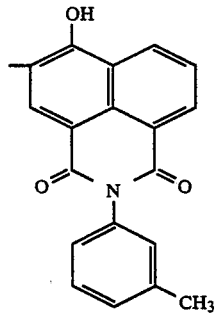 |
| II-46 | 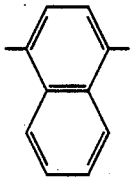 | 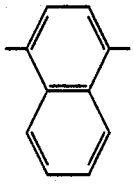 | 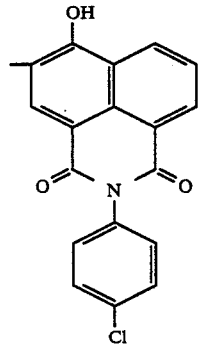 |
| II-47 | 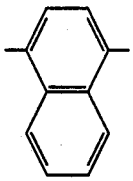 | 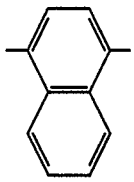 | 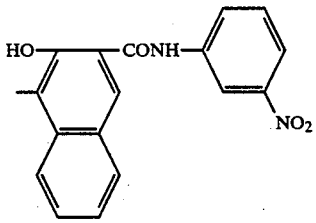 |
| II-48 | " | 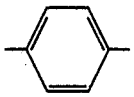 | " |
| II-49 | 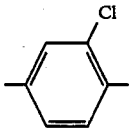 | 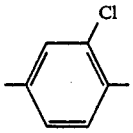 | 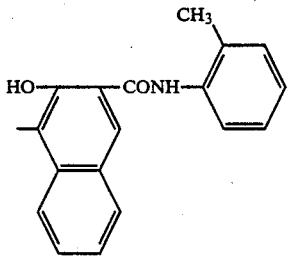 |

-continued
Exemplary compound group [II]:
$X^2—N=N—A^2—N=N—A^3—N=N—X^3$
| Compound No. | $—A^2—$ | $—A^3—$ | $—X^2, —X^3$ |
|---|---|---|---|
| II-50 | 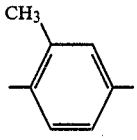 | 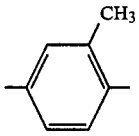 | 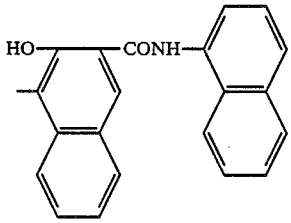 |
| II-51 | 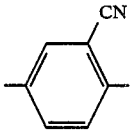 | 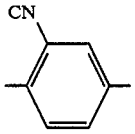 | " |
| II-52 | 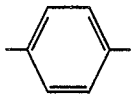 | 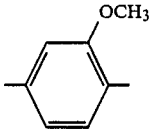 | 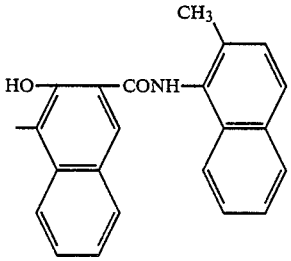 |
| II-53 | " | 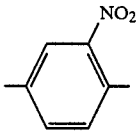 | 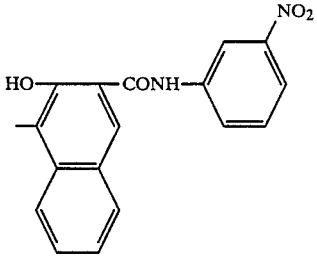 |
| II-54 | 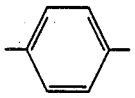 | 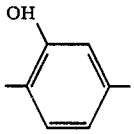 | 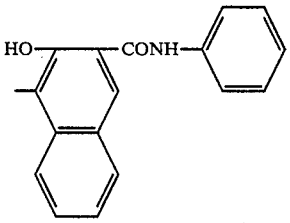 |
| II-55 | 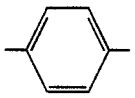 | 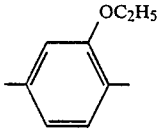 | 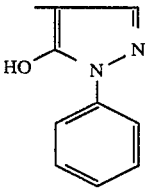 |

-continued
Exemplary compound group [II]:
$X^2—N=N—A^2—N=N—A^3—N=N—X^3$
| Compound No. | $—A^2—$ | $—A^3—$ | $—X^2, —X^3$ |
|---|---|---|---|
| II-56 | 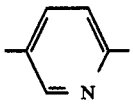 | 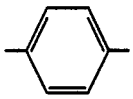 | 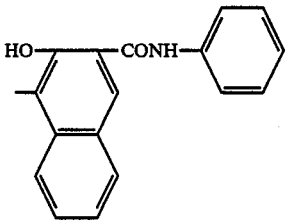 |
| II-57 | 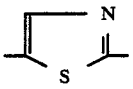 | 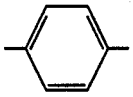 | 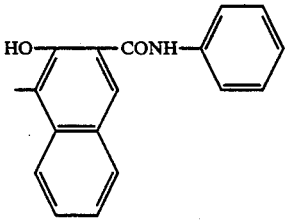 |
| II-58 | 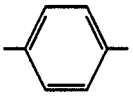 | 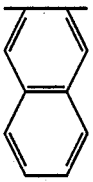 | 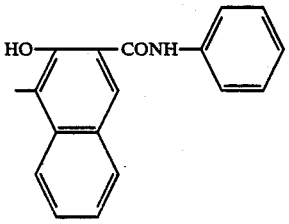 |
| II-59 | 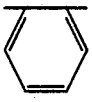 | 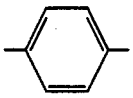 | 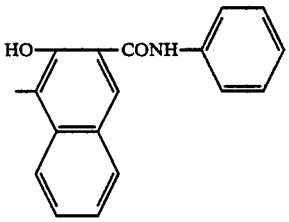 |
| II-60 | 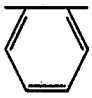 | 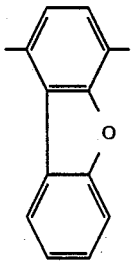 | 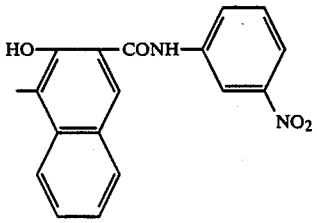 |
| II-61 | 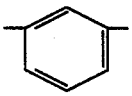 | 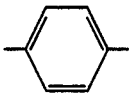 | 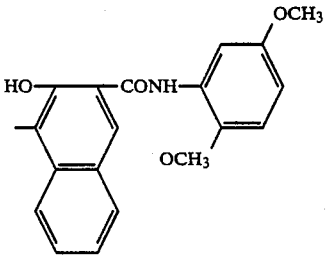 |

-continued
Exemplary compound group [II]:
$X^2—N=N—A^2—N=N—A^3—N=N—X^3$
| Compound No. | $—A^2—$ | $—A^3—$ | $—X^2$, $—X^3$ |
|---|---|---|---|
| II-62 | 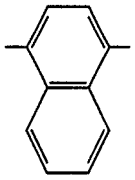 | 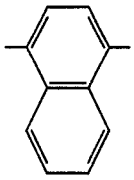 | 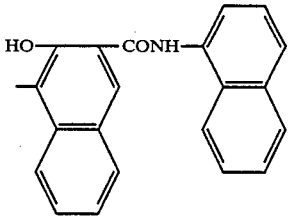  |
| II-63 | 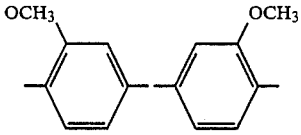  | | 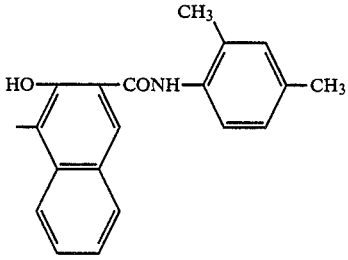  |
| II-64 | 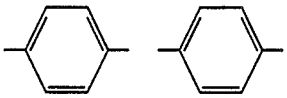 | | 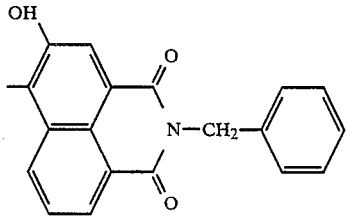  |
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-1 | 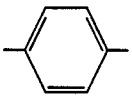 | 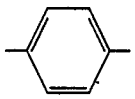 | 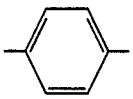 | 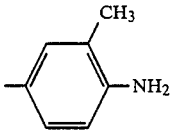  |
| III-2 | " | " | " | 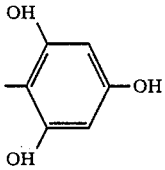  |
| III-3 | " | " | " | 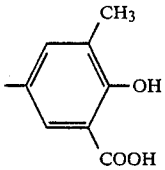  |
| III-4 | " | " | " | 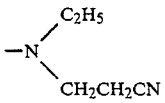  |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-5 | " | " | " | 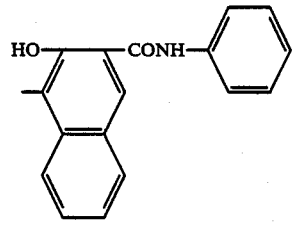 |
| III-6 | " | " | " | 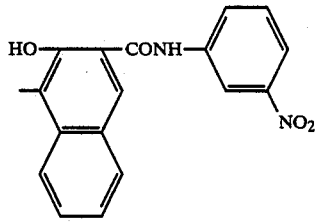 |
| III-7 | 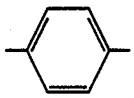 | 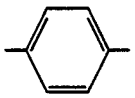 | 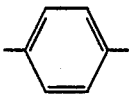 | 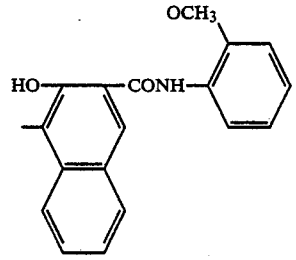 |
| III-8 | " | " | " | 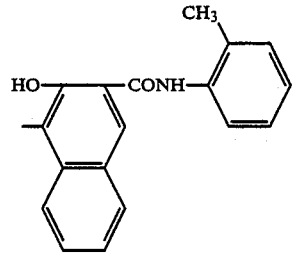 |
| III-9 | " | " | " | 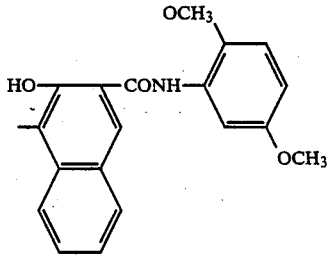 |
| III-10 | " | " | " | 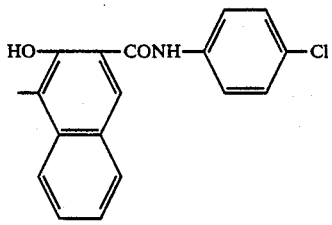 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-11 | " | " | " | 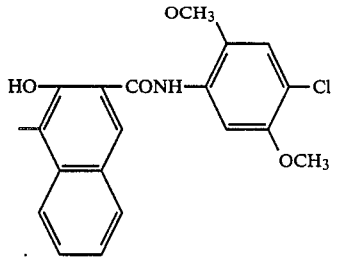 |
| III-12 | 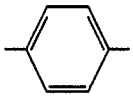 | 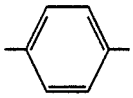 | 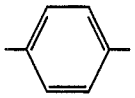 | 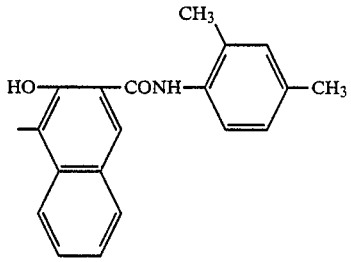 |
| III-13 | " | " | " | 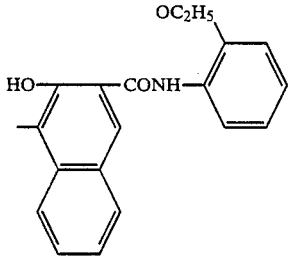 |
| III-14 | " | " | " | 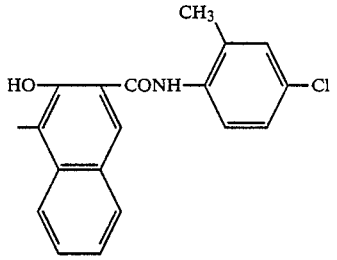 |
| III-15 | " | " | " | 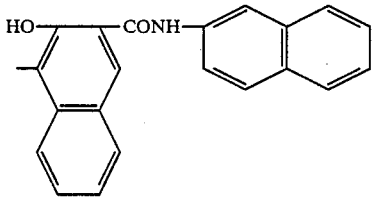 |
| III-16 | " | " | " | 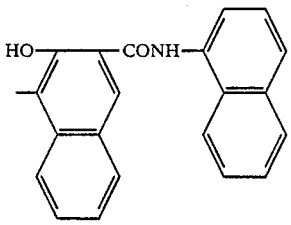 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-17 | 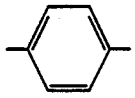 | 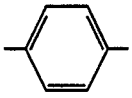 | 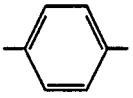 | 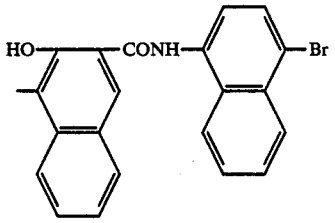 |
| III-18 | " | " | " | 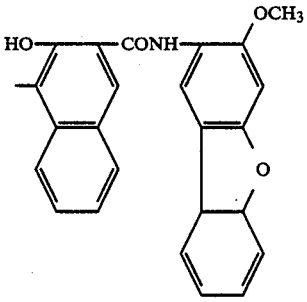 |
| III-19 | " | " | " | 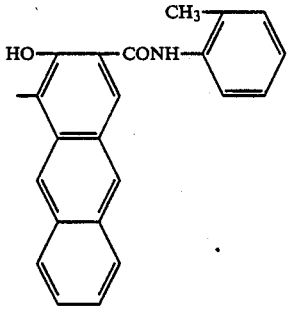 |
| III-20 | " | " | " | 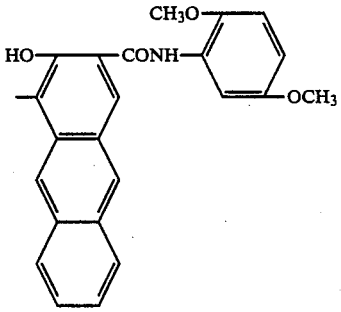 |
| III-21 | " | " | " | 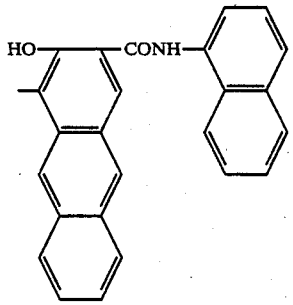 |

-continued
Exemplary compound group [III]:
$X^1-N=N-A^1-N=N-A^5-N=N-A^6-N=N-X^5$
| Compound No. | $-A^4-$ | $-A^5-$ | $-A^6-$ | $-X^4$, $-X^5$ |
|---|---|---|---|---|
| III-22 | 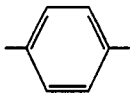 | 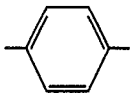 | 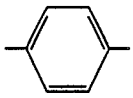 | 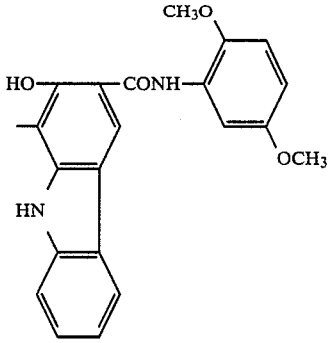 |
| III-23 | " | " | " | 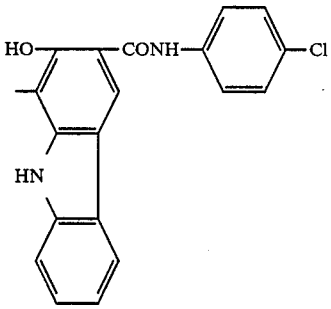 |
| III-24 | " | " | " | 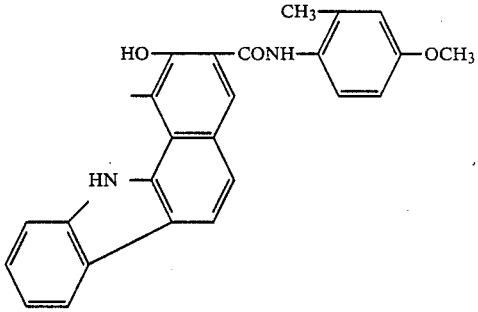 |
| III-25 | " | " | " | 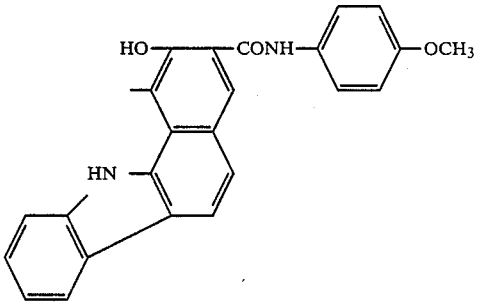 |
| III-26 | " | " | " | 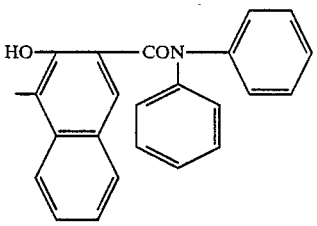 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-27 | 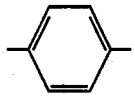 | 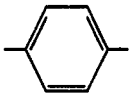 | 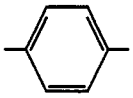 | 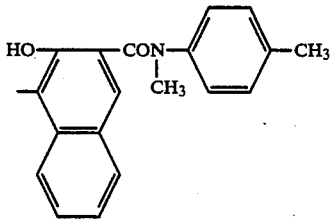 |
| III-28 | " | " | " | 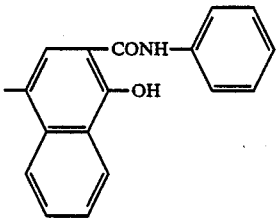 |
| III-29 | " | " | " | 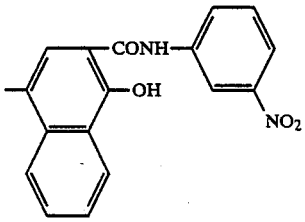 |
| III-30 | " | " | " | 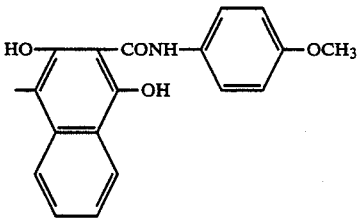 |
| III-31 | " | " | " | 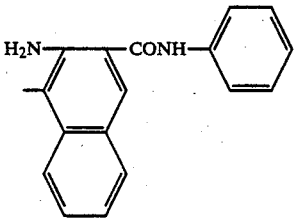 |
| III-32 | 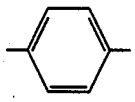 | 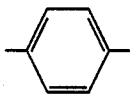 | 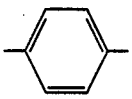 | 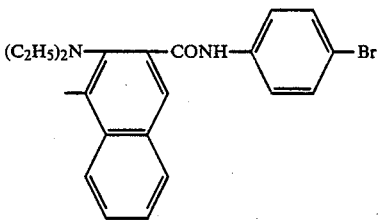 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-33 | " | " | " | 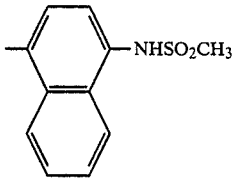 |
| III-34 | " | " | " | 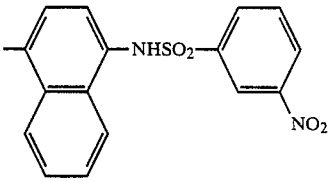 |
| III-35 | " | " | " | 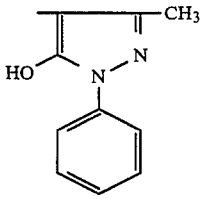 |
| III-36 | " | " | " | 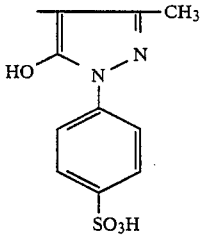 |
| III-37 | 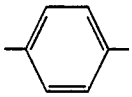 | 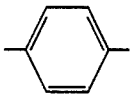 | 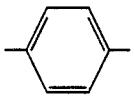 | 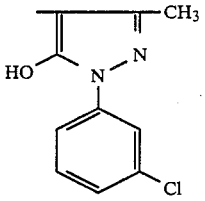 |
| III-38 | " | " | " | 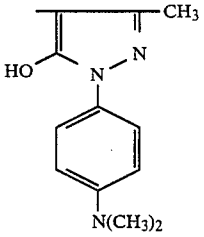 |
| III-39 | " | " | " | 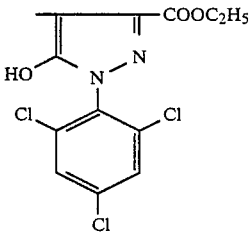 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-40 | " | " | " | 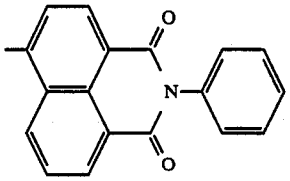 |
| III-41 | " | " | " | 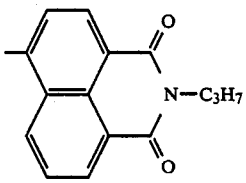 |
| III-42 | 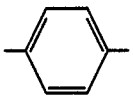 | 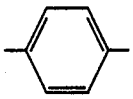 | 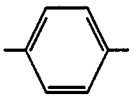 | 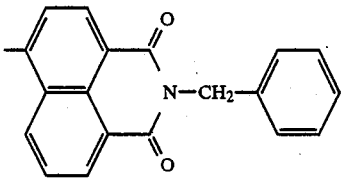 |
| III-43 | " | " | " | 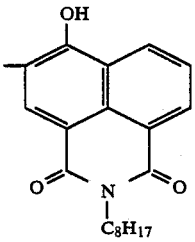 |
| III-44 | " | " | " | 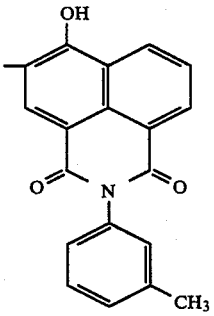 |
| III-45 | " | " | " | 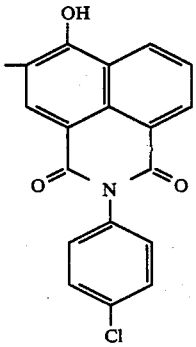 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-46 | " | " | " | 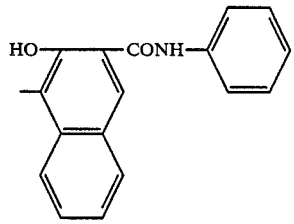 |
| III-47 | 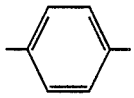 | 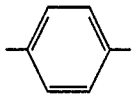 | 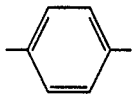 | 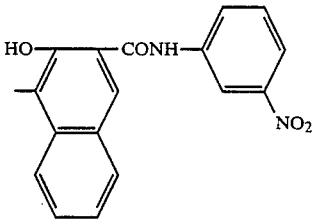 |
| III-48 | 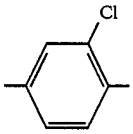 | " | 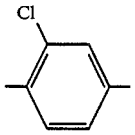 | 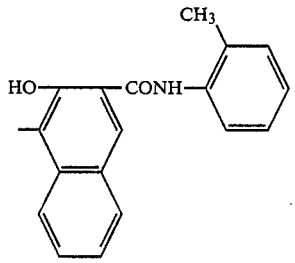 |
| III-49 | 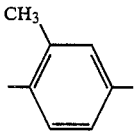 | " | 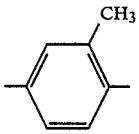 | 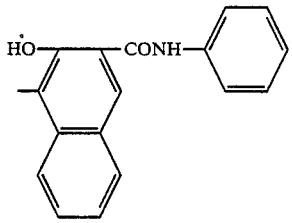 |
| III-50 | 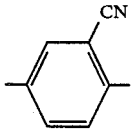 | " | 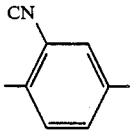 | 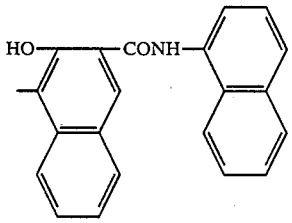 |
| III-51 | 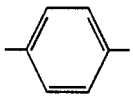 | " | 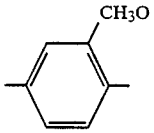 | 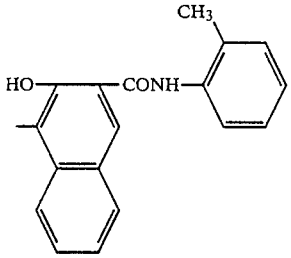 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-52 | 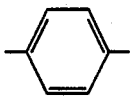 | 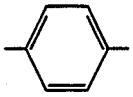 | 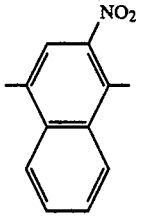 | 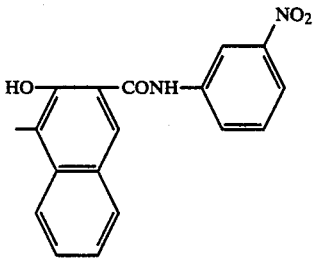 |
| III-53 | " | " | 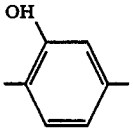 | 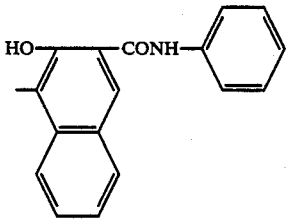 |
| III-54 | " | " | 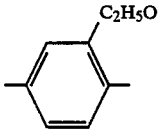 | 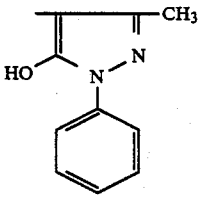 |
| III-55 | 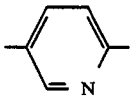 | " | 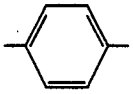 | 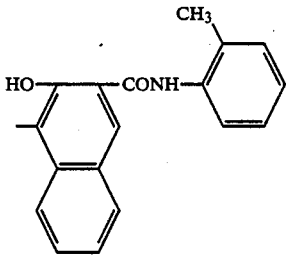 |
| III-56 | 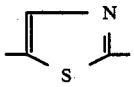 | " | " | 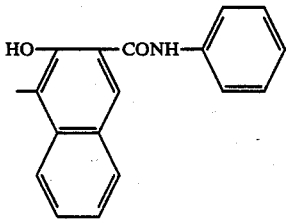 |
| III-57 | 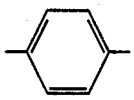 | 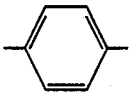 | 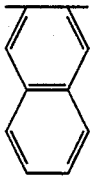 | 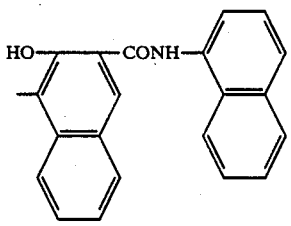 |

-continued
Exemplary compound group [III]:
$X^1—N=N—A^1—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-58 | 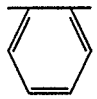 | " | 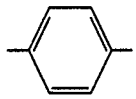 | 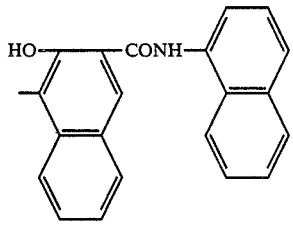 |
| III-59 | " | " | 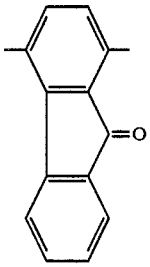 | 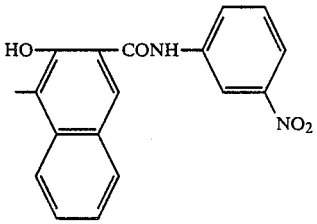 |
| | | | | $—X^4$ 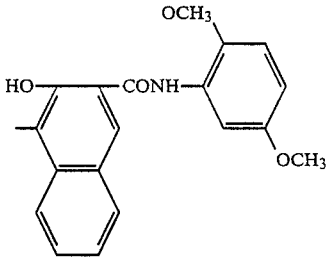 |
| III-60 | 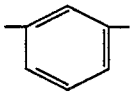 | " | 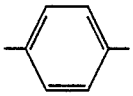 | $—X^5$ 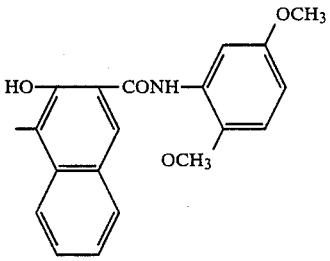 |
| III-61 | 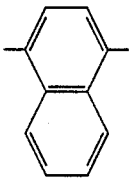 | 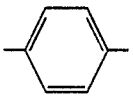 | 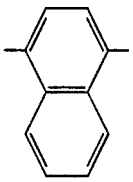 | 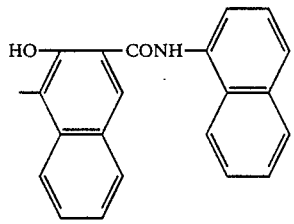 |

-continued
Exemplary compound group [III]:
$X^1-N=N-A^1-N=N-A^5-N=N-A^6-N=N-X^5$
| Compound No. | $-A^4-$ | $-A^5-$ | $-A^6-$ | $-X^4$, $-X^5$ |
|---|---|---|---|---|
| III-62 | 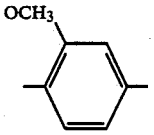 | " | 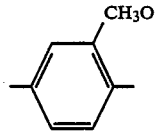 | 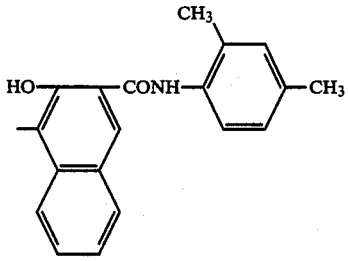 |
| III-63 | 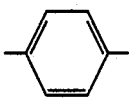 | " | 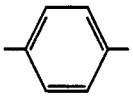 | 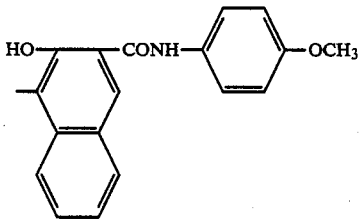 |
| III-64 | " | " | " | 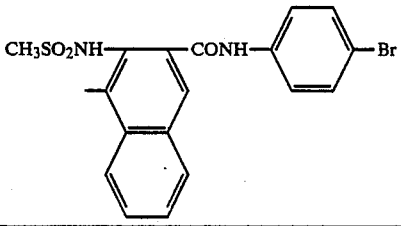 |
Exemplary compound group [IV]:
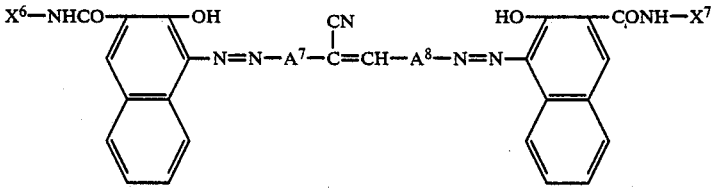
| Compound No. | $-A^7-$ | $-A^8-$ | $-X^6$, $-X^7$ |
|---|---|---|---|
| IV-1 | 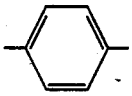 | 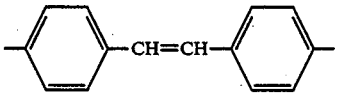 | 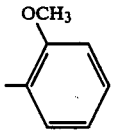 |
| IV-2 | " | " | 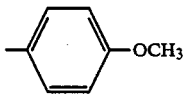 |
| IV-3 | " | " | 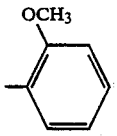 |

-continued
Exemplary compound group [IV]:
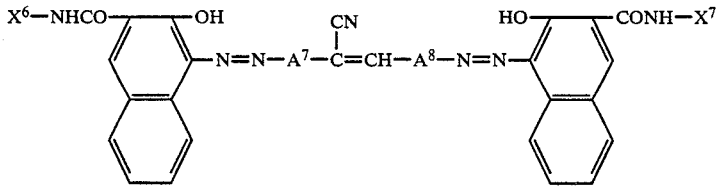
| Compound No. | —A7— | —A8— | —X6,—X7 |
|---|---|---|---|
| IV-4 | " | " | —X6 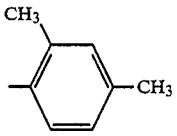 —X7 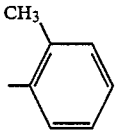 |
| IV-5 | " | 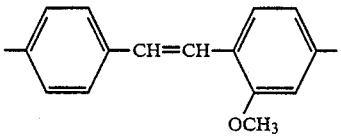 | 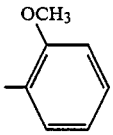 |
| IV-6 | 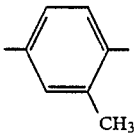 | 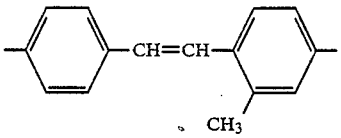 | 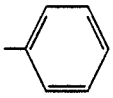 |
| IV-7 | 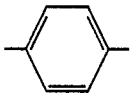 | 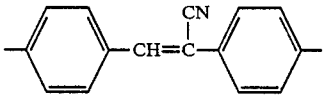 | 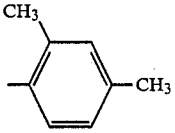 |
| IV-8 | 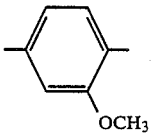 | 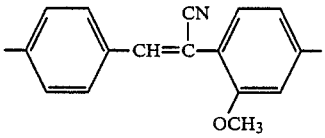 | 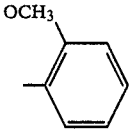 |
| IV-9 | 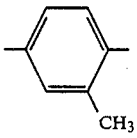 | 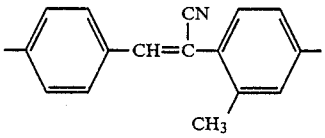 | 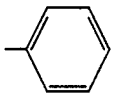 |
| IV-10 | 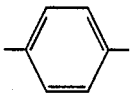 | 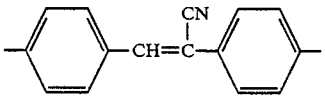 | 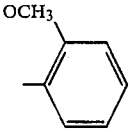 |
| IV-11 | " | " | 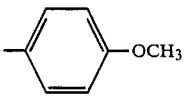 |

-continued
Exemplary compound group [IV]:
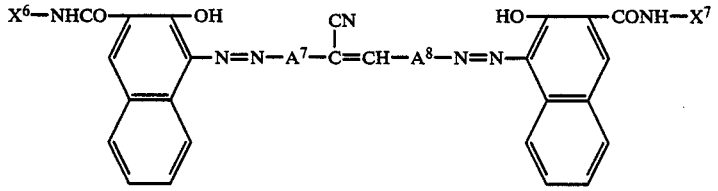
| Compound No. | —A7— | —A8— | —X6,—X7 |
|---|---|---|---|
| IV-12 | " | " | 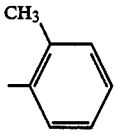 |
| IV-13 | 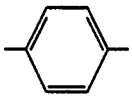 | 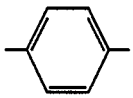 | 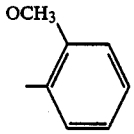 |
| IV-14 | " | " | 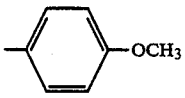 |
| IV-15 | " | " | 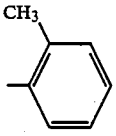 |
| IV-16 | " | " | 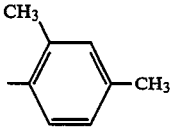 |
| IV-17 | 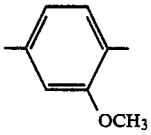 | " | 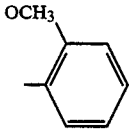 |
| IV-18 | 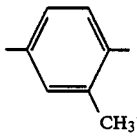 | " | 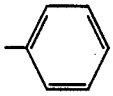 |

Exemplary compound group [V]:
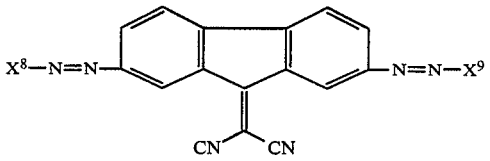
| Compound No. | $-X^8$, $-X^9$ |
|---|---|
| V-1 | 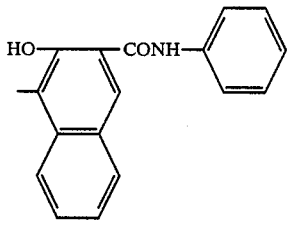 |
| V-2 | 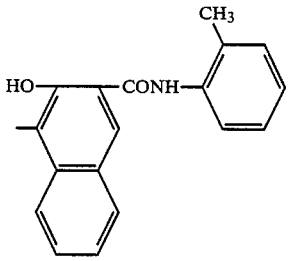 |
| V-3 | 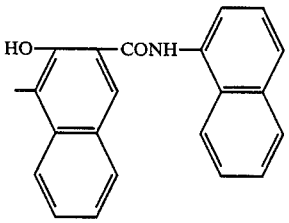 |
| V-4 | 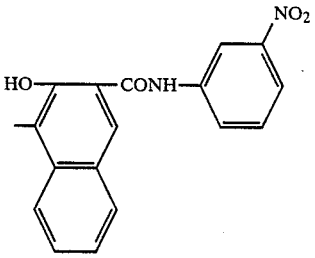 |
| V-5 | 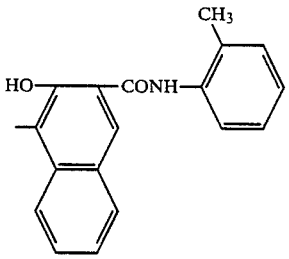 |
-continued
Exemplary compound group [V]:
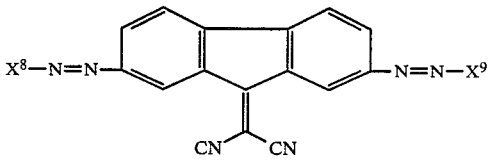
| Compound No. | $-X^8$, $-X^9$ |
|---|---|
| V-6 | 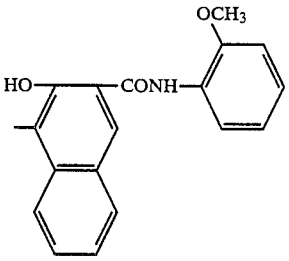 |
| V-7 | 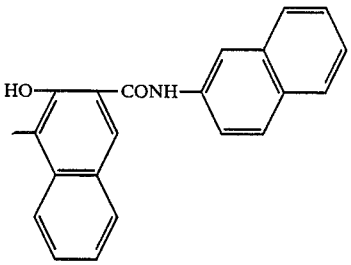 |
| V-8 | 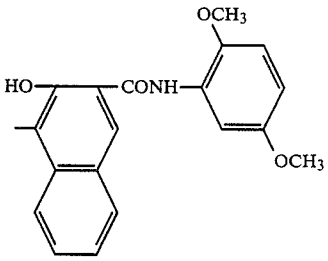 |
| V-9 | 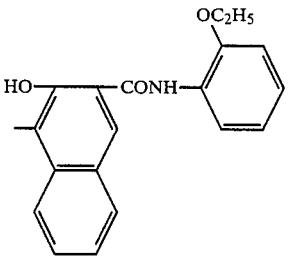 |
| V-10 | 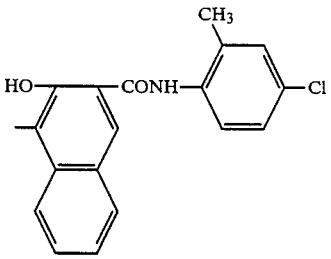 |

-continued
Exemplary compound group [V]:
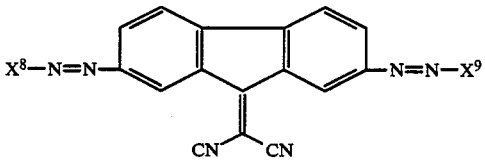
| Compound No. | $-X^8$, $-X^9$ |
|---|---|
| V-11 | 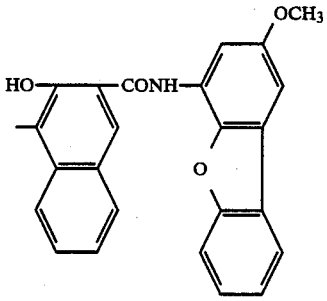 |
| V-12 | 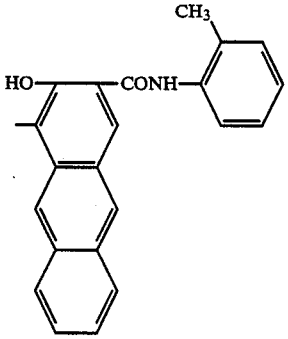 |
| V-13 | 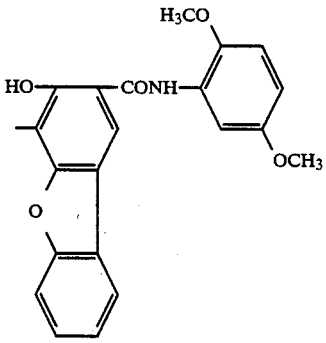 |
| V-14 | 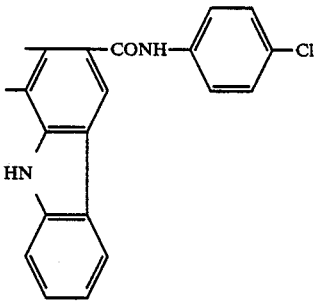 |
-continued
Exemplary compound group [V]:
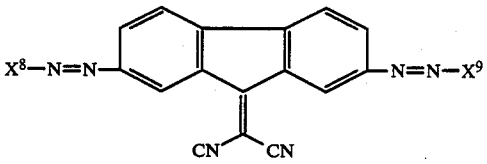
| Compound No. | $-X^8$, $-X^9$ |
|---|---|
| V-15 | 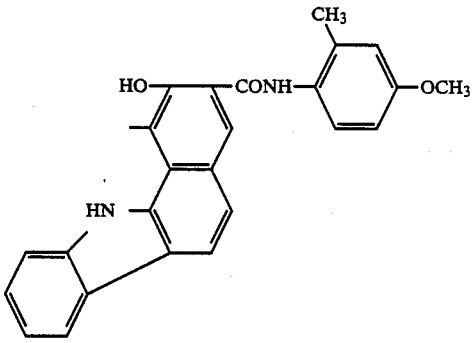 |
| V-16 | 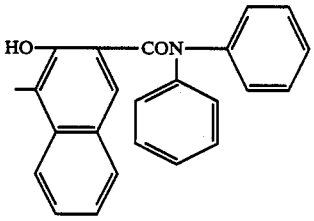 |
| V-17 | 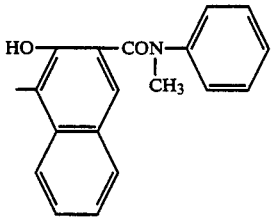 |
| V-18 | 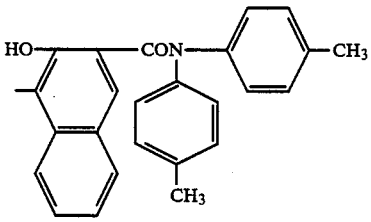 |
| V-19 | 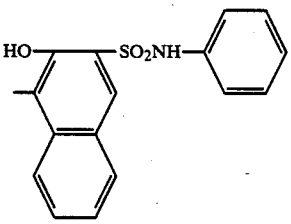 |

-continued

Exemplary compound group [V]:

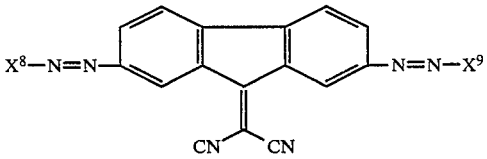

| Compound No. | $-X^8, -X^9$ |
|---|---|
| V-20 | 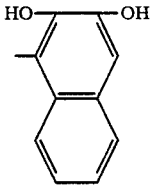 |
| V-21 | 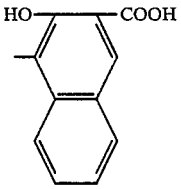 |
| V-22 | 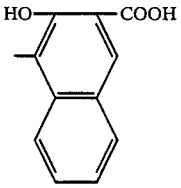 |
| V-23 | 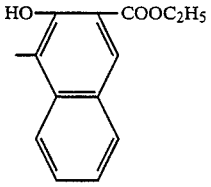 |
| V-24 | 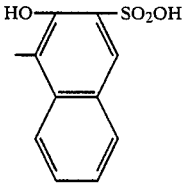 |
| V-25 | 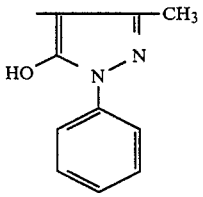 |

-continued

Exemplary compound group [V]:

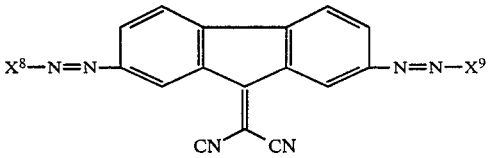

| Compound No. | $-X^8, -X^9$ |
|---|---|
| V-26 | 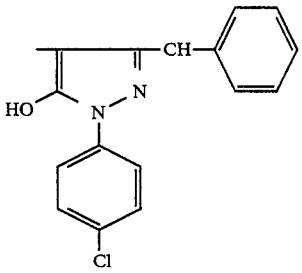 |
| V-27 | 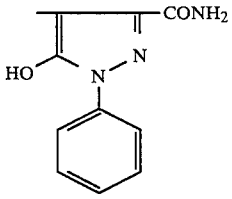 |
| V-28 | 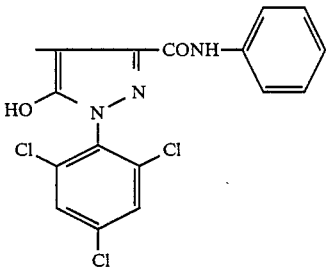 |

The following polycyclic quinone pigments shown as exemplary compound groups [VI]~[VIII] can be used most advantageously as CGM.

Exemplary compound group [VI]:

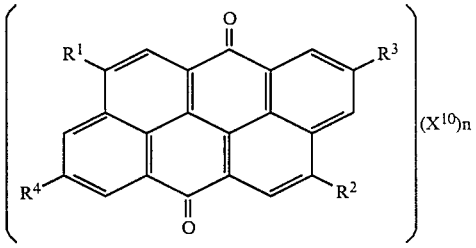

| Compound No. | $R^1$ | $R^2$ | $R^3$ | $R^4$ | $X^{10}$ | n |
|---|---|---|---|---|---|---|
| VI-1 | — | — | — | — | — | 0 |
| VI-2 | Cl | Cl | — | — | — | 0 |
| VI-3 | Br | Br | — | — | — | 0 |
| VI-4 | — | — | Br | Br | — | 0 |
| VI-5 | Br | Br | Br | Br | — | 0 |
| VI-6 | — | — | — | — | I | 2 |
| VI-7 | — | — | — | — | " | 3 |

-continued

Exemplary compound group [VI]:

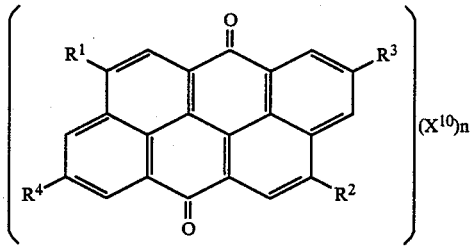

| Compound No. | $R^1$ | $R^2$ | $R^3$ | $R^4$ | $X^{10}$ | n |
|---|---|---|---|---|---|---|
| VI-8 | — | — | — | — | " | 4 |
| VI-9 | — | — | — | — | $NO_2$ | 2 |
| VI-10 | — | — | — | — | CN | 2 |
| VI-11 | — | — | — | — | $COCH_3$ | 2 |

Exemplary compound group [VII]:

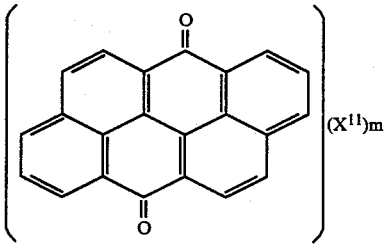

| Compound No. | $X^{11}$ | m |
|---|---|---|
| VII-1 | — | 0 |
| VII-2 | Cl | 2 |
| VII-3 | Br | 2 |
| VII-4 | I | 2 |
| VII-5 | I | 3 |
| VII-6 | I | 4 |
| VII-7 | $NO_2$ | 2 |
| VII-8 | CN | 2 |
| VII-9 | $COC_6H_5$ | 2 |

Exemplary compound group [VIII]:

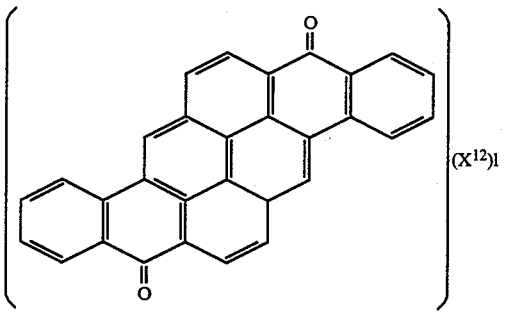

| Compound No. | $X^{12}$ | l |
|---|---|---|
| VIII-1 | — | 0 |
| VIII-2 | Cl | 2 |
| VIII-3 | Br | 2 |
| VIII-4 | " | 3 |
| VIII-5 | " | 4 |
| VIII-6 | I | 4 |
| VIII-7 | $NO_2$ | 3 |
| VIII-8 | CN | 4 |
| VIII-9 | $COCH_3$ | 4 |

The charge transporting materials useful for the purpose of the invention are not particularly limited, and they may be, for example, oxazole derivatives, oxadiazole derivatives, thiazole derivatives, thiadiazole derivatives, triazole derivatives, imidazole derivatives, imidazolone derivatives, imidazolidine derivatives, styryl compounds, hydrazone compounds, pyrazoline derivatives, oxazolone derivatives, benzothiazole derivatives, Benzimidazole derivatives, quinazoline derivatives, benzofuran derivatives, acridine derivatives, phenazine derivatives, aminostilbene derivatives, poly-1-vinylpyrene, poly-9-vinylanthracene, etc.

However, those having good base-oriented transport capability with respect to holes produced upon light illumination and well suited for use in combination with aforesaid carrier generating materials are preferred. Examples of such CTM are those shown below as exemplary compound group [IX] or [X].

Exemplary compound group [IX]:

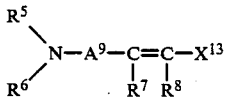

| Compound No. | $-R^5$ | $-R^6$ | $-R^7$ | $-R^8$ | $-A^9-$ | $-X^{13}$ |
|---|---|---|---|---|---|---|
| IX-1 | 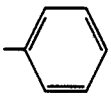 | 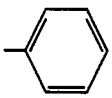 | —H | 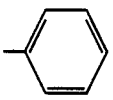 | 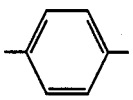 | 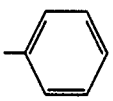 |
| IX-2 | 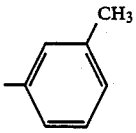 | " | " | " | " | 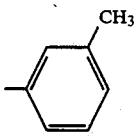 |

-continued
Exemplary compound group [IX]:
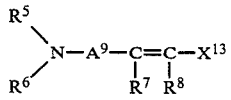
| Compound No. | $-R^5$ | $-R^6$ | $-R^7$ | $-R^8$ | $-A^9-$ | $-X^{13}$ |
|---|---|---|---|---|---|---|
| IX-3 | 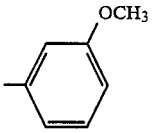 | " | " | " | " | 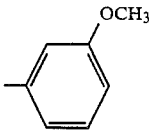 |
| IX-4 | $-CH_3$ | $-CH_3$ | " | $-H$ | " | 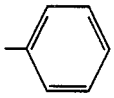 |
| IX-5 | $-C_2H_5$ | $-C_2H_5$ | " | " | " | " |
| IX-6 | " | " | " | " | " | 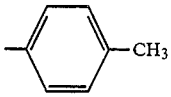 |
| IX-7 | " | " | " | " | " | 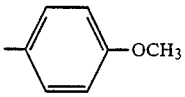 |
| IX-8 | 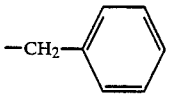 | 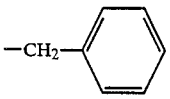 | " | " | " | 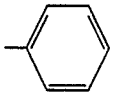 |
| IX-9 | 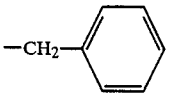 | 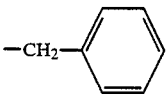 | $-H$ | 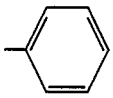 | 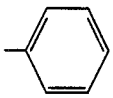 | 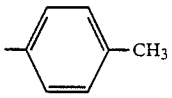 |
| IX-10 | " | " | " | " | " | 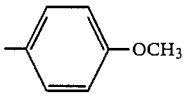 |
| IX-11 | " | " | $-H$ | $-H$ | 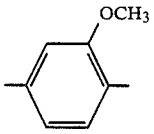 | 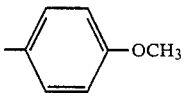 |
| IX-12 | $-C_2H_5$ | " | " | " | 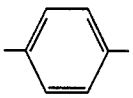 | " |
| IX-13 | 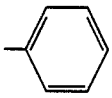 | 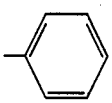 | " | " | " | 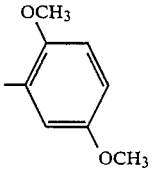 |

-continued
Exemplary compound group [IX]:
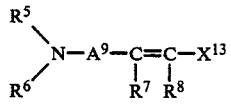
| Compound No. | $-R^5$ | $-R^6$ | $-R^7$ | $-R^8$ | $-A^9-$ | $-X^{13}$ |
|---|---|---|---|---|---|---|
| IX-14 | " | " | " | " | " | 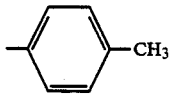 |
| IX-15 | " | " | " | " | " | 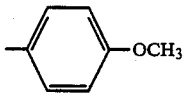 |
| IX-16 | " | " | " | " | " | 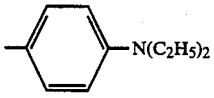 |
| IX-17 | " | " | " | " | " | 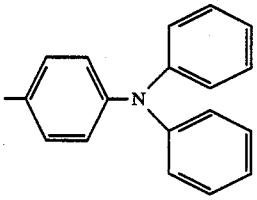 |
| IX-18 | " | " | " | " | 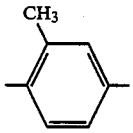 | 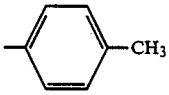 |
| IX-19 | 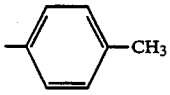 | 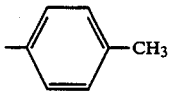 | —H | —H | 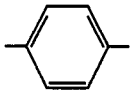 | 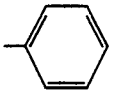 |
| IX-20 | " | " | " | " | " | 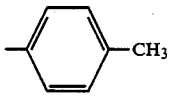 |
| IX-21 | " | " | —H | —H | 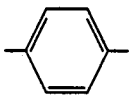 | 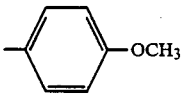 |
| IX-22 | " | " | —H | —H | 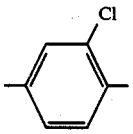 | 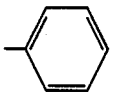 |
| IX-23 | " | " | " | " | 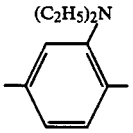 | 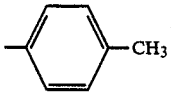 |

-continued
Exemplary compound group [IX]:
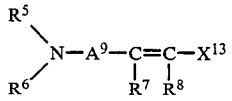
| Compound No. | $-R^5$ | $-R^6$ | $-R^7$ | $-R^8$ | $-A^9-$ | $-X^{13}$ |
|---|---|---|---|---|---|---|
| IX-24 | 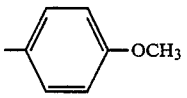 | 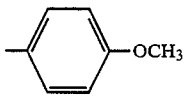 | " | " | 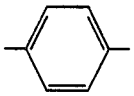 | 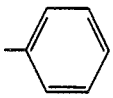 |
| IX-25 | " | " | " | " | " | 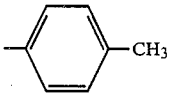 |
| IX-26 | " | " | " | " | " | 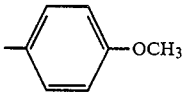 |
| IX-27 | " | " | " | " | 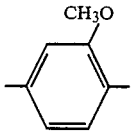 | 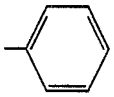 |
| IX-28 | $-C_2H_5$ | $-C_2H_5$ | " | " | 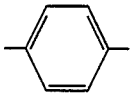 | 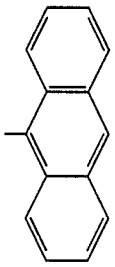 |
| IX-29 | 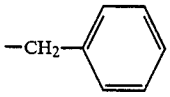 | 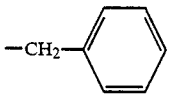 | $-H$ | $-H$ | 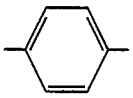 | 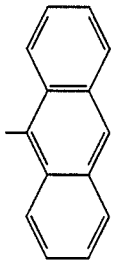 |
| IX-30 | " | " | " | " | 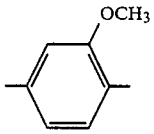 | " |
| IX-31 | 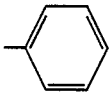 | 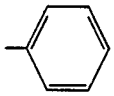 | " | " | 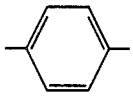 | 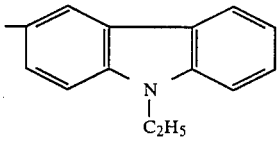 |

-continued
Exemplary compound group [IX]:
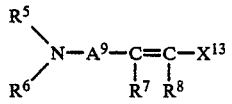
| Compound No. | $-R^5$ | $-R^6$ | $-R^7$ | $-R^8$ | $-A^9-$ | $-X^{13}$ |
|---|---|---|---|---|---|---|
| IX-32 | " | " | " | " | 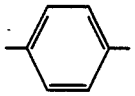 | 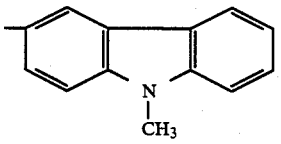 |
| IX-33 | 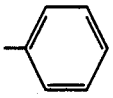 | 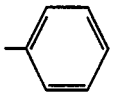 | —H | —H | 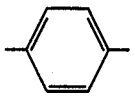 | 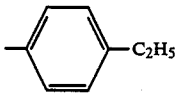 |
| IX-34 | " | " | " | " | " | 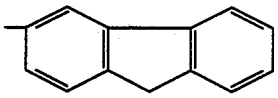 |
| IX-35 | 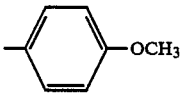 | " | " | " | " | 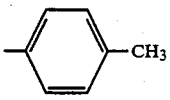 |
| IX-36 | " | " | " | " | " | 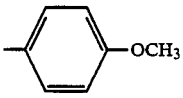 |
| IX-37 | 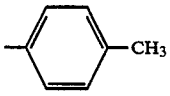 | " | " | " | " | " |
| IX-38 | 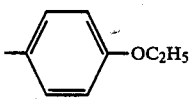 | " | " | " | " | 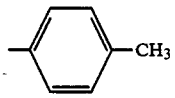 |
| IX-39 | 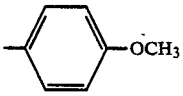 | 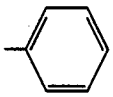 | —H | —H | 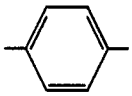 | 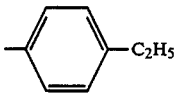 |
| IX-40 | " | " | " | " | " | 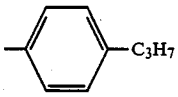 |
| IX-41 | " | " | " | " | " | 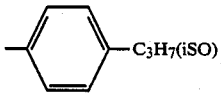 |
| IX-42 | " | " | " | " | " | 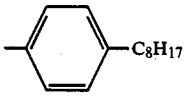 |

-continued
Exemplary compound group [IX]:
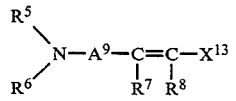
| Compound No. | $-R^5$ | $-R^6$ | $-R^7$ | $-R^8$ | $-A^9-$ | $-X^{13}$ |
|---|---|---|---|---|---|---|
| IX-43 | " | " | " | " | " | 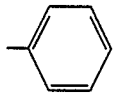 |
| IX-44 | " | " | " | " | " | 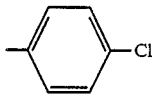 |
| IX-45 | " | " | " | " | " | 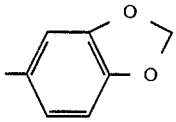 |
| IX-46 | " | " | " | " | " | 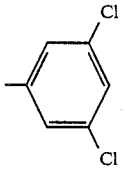 |
| IX-47 | " | " | " | " | " | 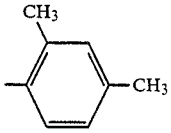 |
| IX-48 | " | " | " | " | " | 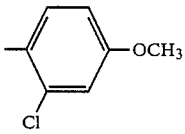 |
| IX-49 | 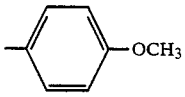 | 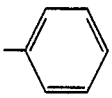 | —H | —H | 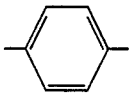 | 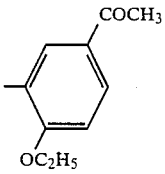 |
| IX-50 | " | " | " | " | " | 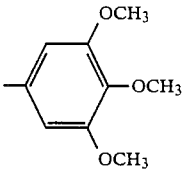 |
| IX-51 | " | " | " | " | " | 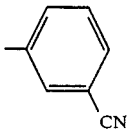 |

-continued
Exemplary compound group [IX]:
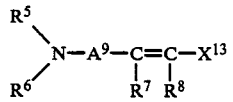
| Compound No. | $-R^5$ | $-R^6$ | $-R^7$ | $-R^8$ | $-A^9-$ | $-X^{13}$ |
|---|---|---|---|---|---|---|
| IX-52 | " | " | " | " | " | 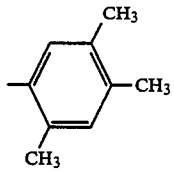 |
| IX-53 | " | " | " | " | " | 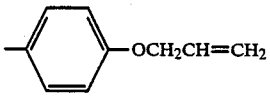 |
| IX-54 | 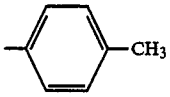 | " | " | " | " | 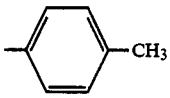 |
| IX-55 | " | " | " | " | " | 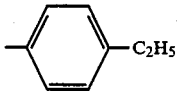 |
| IX-56 | " | " | " | " | " | 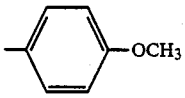 |
| IX-57 | " | " | " | " | " | 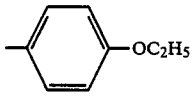 |
| IX-58 | " | " | " | " | " | 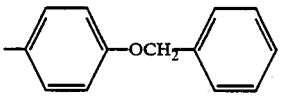 |
| IX-59 | 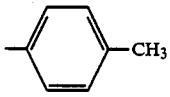 | 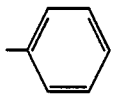 | $-H$ | $-H$ | 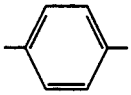 | 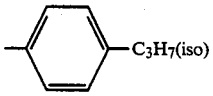 |
| IX-60 | " | " | " | " | " | 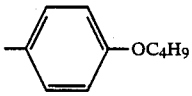 |
| IX-61 | " | " | " | " | " | 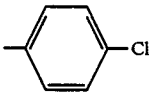 |
| IX-62 | " | " | " | " | " | 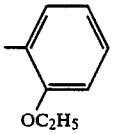 |

-continued
Exemplary compound group [IX]:
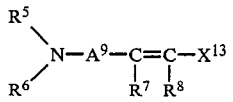
| Compound No. | $-R^5$ | $-R^6$ | $-R^7$ | $-R^8$ | $-A^9-$ | $-X^{13}$ |
|---|---|---|---|---|---|---|
| IX-63 | " | " | " | " | " | 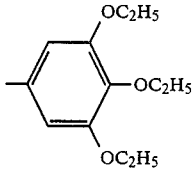 |
| IX-64 | " | " | " | " | " | 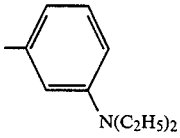 |
| IX-65 | " | " | " | " | " | 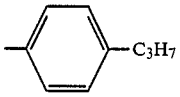 |
| IX-66 | 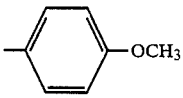 | 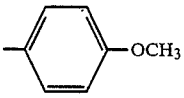 | —H | —H | " | 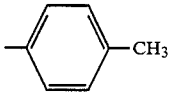 |
| IX-67 | " | 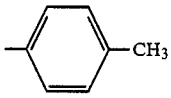 | " | " | " | 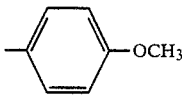 |
| IX-68 | " | " | " | " | " | 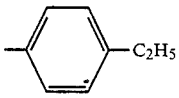 |
| IX-69 | 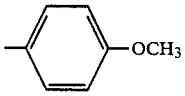 | 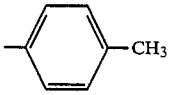 | H | H | 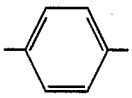 | 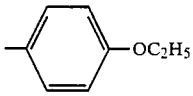 |
| IX-70 | " | " | " | " | " | 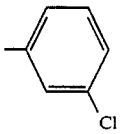 |
| IX-71 | " | " | " | " | " | 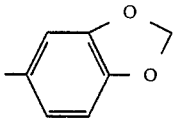 |
| IX-72 | " | " | " | " | 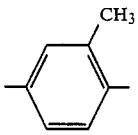 | 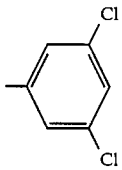 |

-continued
Exemplary compound group [IX]:
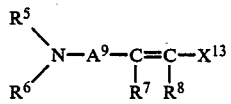
| Compound No. | $-R^5$ | $-R^6$ | $-R^7$ | $-R^8$ | $-A^9-$ | $-X^{13}$ |
|---|---|---|---|---|---|---|
| IX-73 | " | " | " | " | 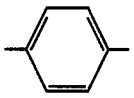 | 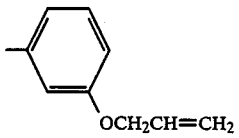 |
| IX-74 | 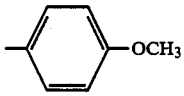 | 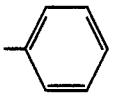 | " | " | " | 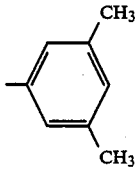 |
| IX-75 | 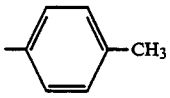 | " | " | " | " | " |
| IX-76 | 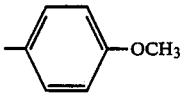 | 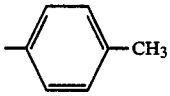 | " | " | " | " |
| IX-77 | 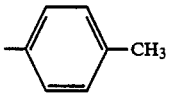 | 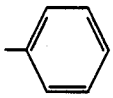 | —H | —H | " | 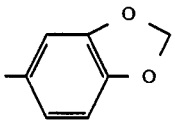 |
| IX-78 | 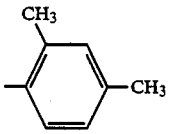 | " | $-CH_3$ | " | " | 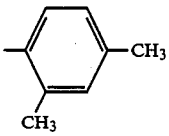 |
| IX-79 | 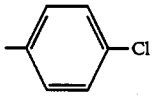 | 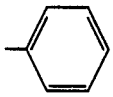 | $-CH_3$ | —H | 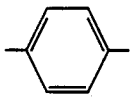 | 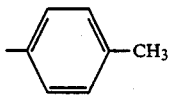 |
| IX-80 | 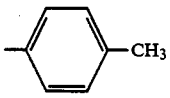 | 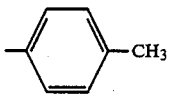 | —H | $-CH_3$ | " | 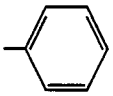 |
| IX-81 | 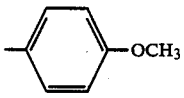 | 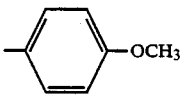 | " | " | " | 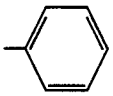 |

Exemplary compound group [X]:
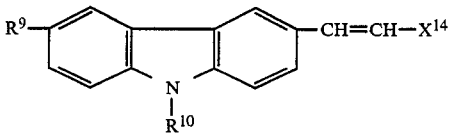
| Compound No. | $-R^9$ | $-R^{10}$ | $-X^{14}$ |
|---|---|---|---|
| X-1 | —H | 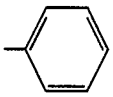 | 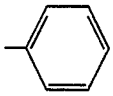 |
| X-2 | " | " | 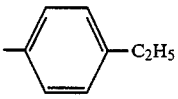  |
| X-3 | " | " | 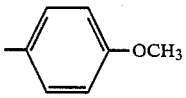  |
| X-4 | " | " | 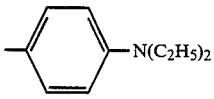  |
| X-5 | —H | 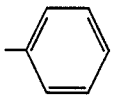 | 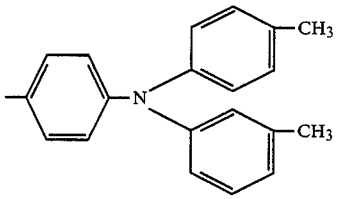  |
| X-6 | " | 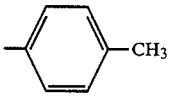  | 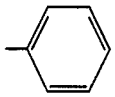 |
| X-7 | " | " | 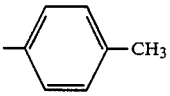  |
| X-8 | " | " | 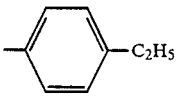  |
| X-9 | " | " | 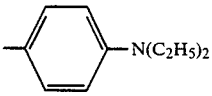  |
| X-10 | " | " | 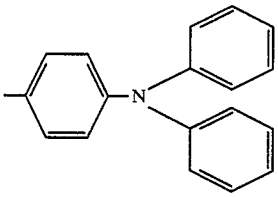  |

-continued
Exemplary compound group [X]:
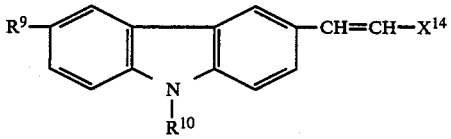
| Compound No. | —R9 | —R10 | —X14 |
|---|---|---|---|
| X-11 | " | 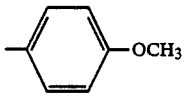  | 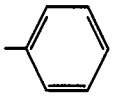 |
| X-12 | " | " | 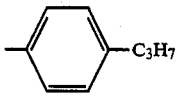  |
| X-13 | " | 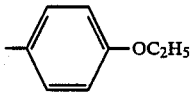  | 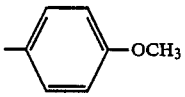  |
| X-14 | —H | 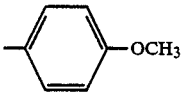  | 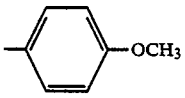  |
| X-15 | " | " | 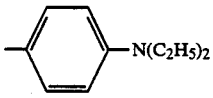  |
| X-16 | " | " | 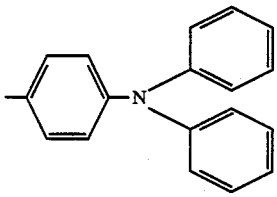  |
| X-17 | " | 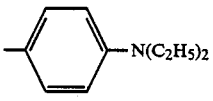  | 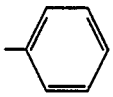 |
| X-18 | " | " | 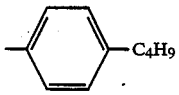  |
| X-19 | " | 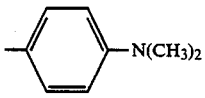  | 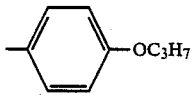  |
| X-20 | " | 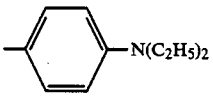  | 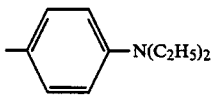  |
| X-21 | " | 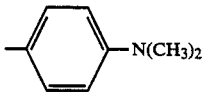  | 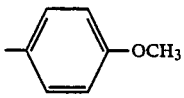  |

-continued
Exemplary compound group [X]:
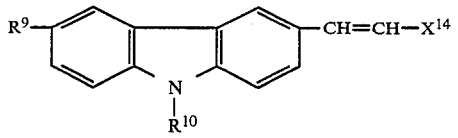
| Compound No. | —R9 | —R10 | —X14 |
|---|---|---|---|
| X-22 | —Cl | 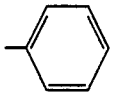 | 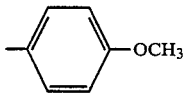 |
| X-23 | —OCH3 | 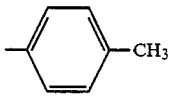 | 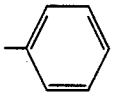 |
| X-24 | —OH | 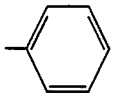 | 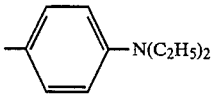 |
| X-25 | —N(C2H5)2 | 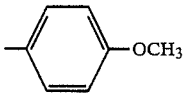 | 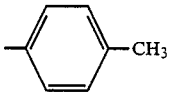 |
| X-26 | —H | 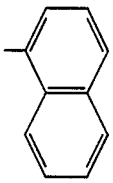 | 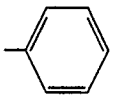 |
| X-27 | " | 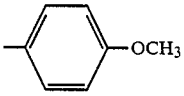 | 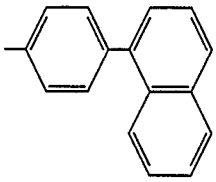 |
| X-28 | " | 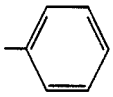 | 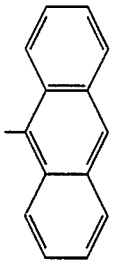 |
| X-29 | " | " | 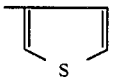 |

-continued
Exemplary compound group [X]:
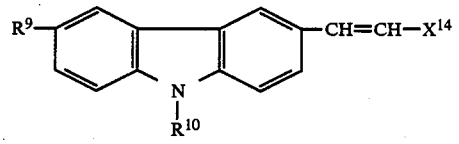
| Compound No. | $-R^9$ | $-R^{10}$ | $-X^{14}$ |
|---|---|---|---|
| X-30 | " | 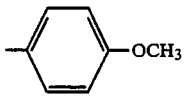 | 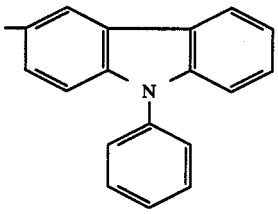 |
| X-31 | $-OCH_3$ | " | 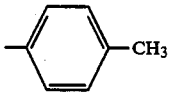 |
| X-32 | $-OCH_3$ | 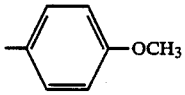 | 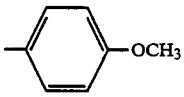 |
| X-33 | " | " | 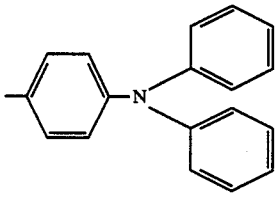 |
Hydrazone compounds shown below as exemplary compound groups [XI]~[XV] may also be used as CTM.
Exemplary compound group [XI]:
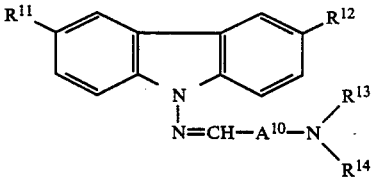
| Compound No. | $-R^{11}$ | $-R^{12}$ | $-R^{13}$ | $-R^{14}$ | $-A^{10}-$ |
|---|---|---|---|---|---|
| XI-1 | $-H$ | $-H$ | 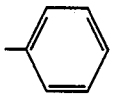 | 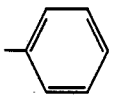 | 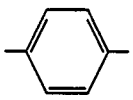 |
| XI-2 | " | " | 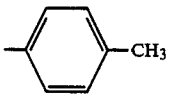 | 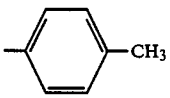 | " |
| XI-3 | " | " | " | 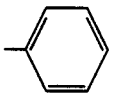 | " |

-continued
Exemplary compound group [XI]:
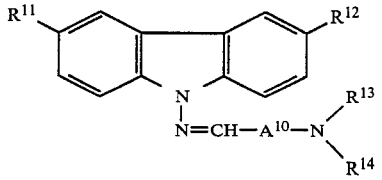
| Compound No. | —R11 | —R12 | —R13 | —R14 | —A10— |
|---|---|---|---|---|---|
| XI-4 | —H | —H | —OCH3 | | |
| XI-5 | " | " | " | —OCH3 | " |
| XI-6 | " | —Cl | | | " |
| XI-7 | " | " | —OCH3 | —OCH3 | " |
| XI-8 | " | " | —CH3 | —CH3 | " |
| XI-9 | " | —H | —Cl | | " |
| XI-10 | " | " | | " | |
| XI-11 | " | " | —OCH3 | | |
| XI-12 | " | " | —C2H5 | " | |
| XI-13 | " | " | —CH3 | —CH3 | " |

-continued

Exemplary compound group [XI]:

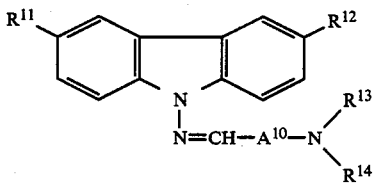

| Compound No. | $-R^{11}$ | $-R^{12}$ | $-R^{13}$ | $-R^{14}$ | $-A^{10}-$ |
|---|---|---|---|---|---|
| XI-14 | " | —Cl | 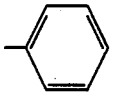 | 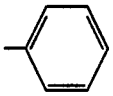 | 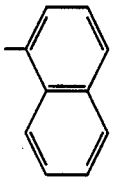 |

Exemplary compound group [XII]:

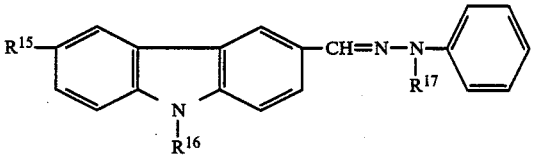

| Compound No. | $-R^{15}$ | $-R^{16}$ | $-R^{17}$ |
|---|---|---|---|
| XII-1 | —H | $-CH_3$ | $-CH_3$ |
| XII-2 | " | " | $-C_2H_5$ |
| XII-3 | " | " | 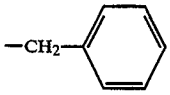 |
| XII-4 | " | " | 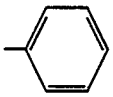 |
| XII-5 | " | $-C_2H_5$ | $-CH_3$ |
| XII-6 | " | " | $-C_2H_5$ |

-continued

Exemplary compound group [XII]:

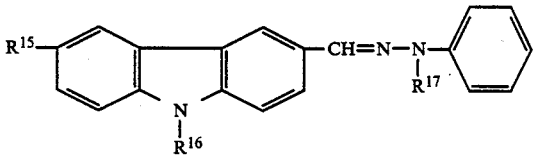

| Compound No. | $-R^{15}$ | $-R^{16}$ | $-R^{17}$ |
|---|---|---|---|
| XII-7 | " | " | 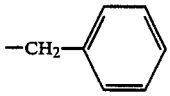 |
| XII-8 | " | " | 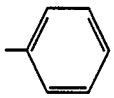 |
| XII-9 | " | $-CH_2CH_2OH$ | $-CH_3$ |
| XII-10 | " | " | $-C_2H_5$ |
| XII-11 | " | " | 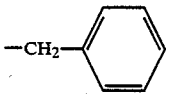 |
| XII-12 | —Cl | " | " |

Exemplary compound group [XIII]:

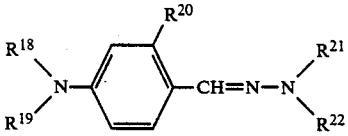

| Compound No. | $-R^{18}$ | $-R^{19}$ | $-R^{20}$ | $-R^{21}$ | $-R^{22}$ |
|---|---|---|---|---|---|
| XIII-1 | $-C_2H_5$ | $-C_2H_5$ | —H | 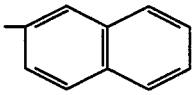 | 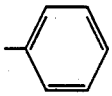 |

-continued
Exemplary compound group [XIII]:
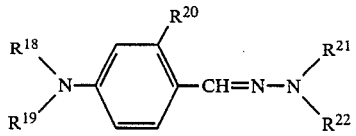
| Compound No. | $-R^{18}$ | $-R^{19}$ | $-R^{20}$ | $-R^{21}$ | $-R^{22}$ |
|---|---|---|---|---|---|
| XIII-2 | " | " | " | 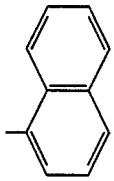 | " |
| XIII-3 | " | " | " | " | 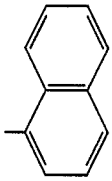 |
| XIII-4 | " | " | " | 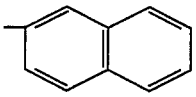 | 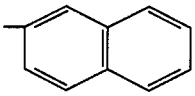 |
| XIII-5 | " | " | " | " | 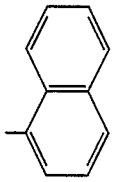 |
| XIII-6 | $-C_3H_7$ | $-C_3H_7$ | " | 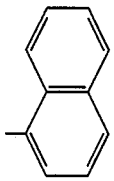 | 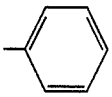 |
| XIII-7 | $-C_4H_9$ | $-C_4H_9$ | " | 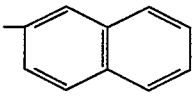 | " |
| XIII-8 | 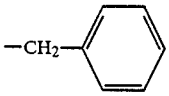 | 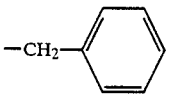 | " | 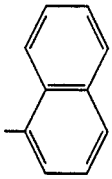 | " |
| XIII-9 | 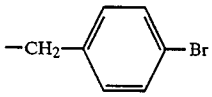 | 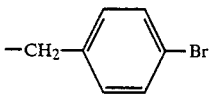 | $-H$ | 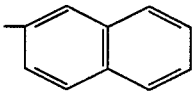 | 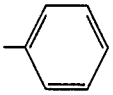 |

-continued
Exemplary compound group [XIII]:
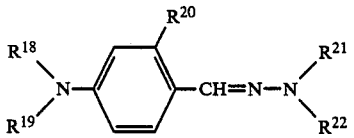
| Compound No. | $-R^{18}$ | $-R^{19}$ | $-R^{20}$ | $-R^{21}$ | $-R^{22}$ |
|---|---|---|---|---|---|
| XIII-10 | 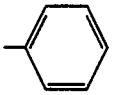 | 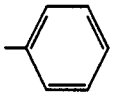 | " | 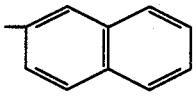 | " |
| XIII-11 | $-C_2H_5$ | $-(CH_2)_2N(CH_3)_2$ | " | " | 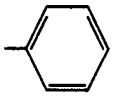 |
| XIII-12 | " | $-CH_2CH_2OCH_3$ | " | " | " |
| XIII-13 | " | $-C_2H_5$ | $-CH_3$ | 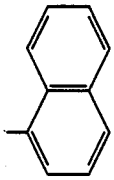 | " |
| XIII-14 | " | " | $-OCH_3$ | " | " |
| XIII-15 | " | " | $-OC_4H_9$ | " | " |
| XIII-16 | 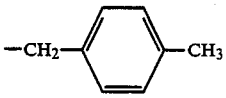 | | $-H$ | " | " |
| XIII-17 | $-C_2H_5$ | $-C_2H_5$ | " | 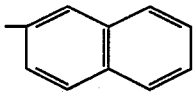 | 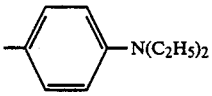 |
| XIII-18 | " | " | " | " | 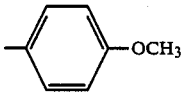 |
| XIII-19 | $-C_2H_5$ | $-CH_2CH_2Cl$ | $-H$ | 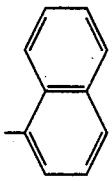 | 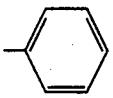 |
| XIII-20 | " | $-C_2H_5$ | " | 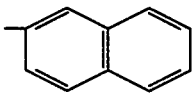 | 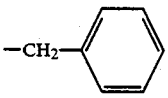 |
| XIII-21 | " | " | " | " | $-C_2H_5$ |
| XIII-22 | $-C_3H_7$ | $-C_3H_7$ | " | 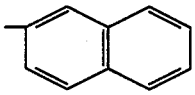 | 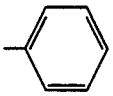 |

Exemplary compound group [XIV]:
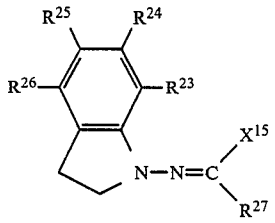
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-1 | —H | —H | —H | —H | —H | 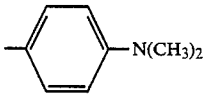 |
| XIV-2 | " | " | " | " | " | 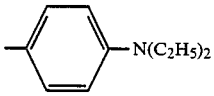 |
| XIV-3 | " | " | " | " | " | 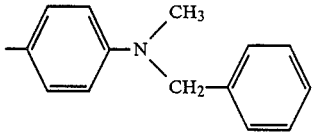 |
| XIV-4 | —H | —H | $-CH_3$ | —H | —H | 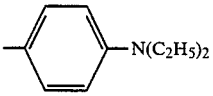 |
| XIV-5 | " | " | —H | " | " | 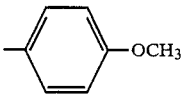 |
| XIV-6 | " | " | $-OCH_3$ | " | " | 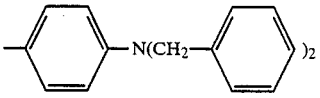 |
| XIV-7 | " | " | —H | " | " | 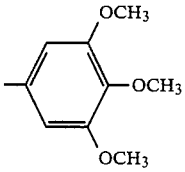 |
| XIV-8 | " | " | " | " | " | 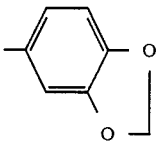 |
| XIV-9 | " | " | " | " | " | 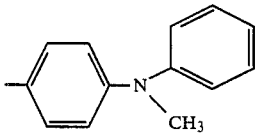 |

-continued
Exemplary compound group [XIV]:
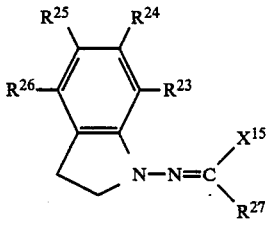
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-10 | " | " | " | " | " | 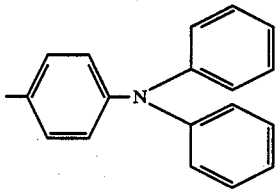 |
| XIV-11 | " | $-CH_3$ | " | " | " | " |
| XIV-12 | " | —H | " | " | " | 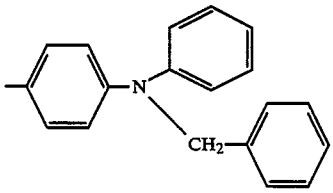 |
| XIV-13 | —H | —H | —H | —H | —H | 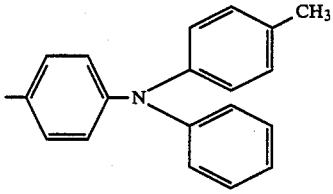 |
| XIV-14 | " | " | " | " | " | 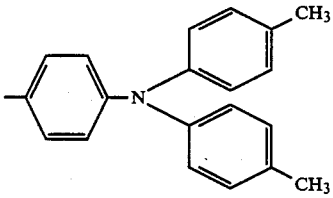 |
| XIV-15 | " | " | " | " | " | 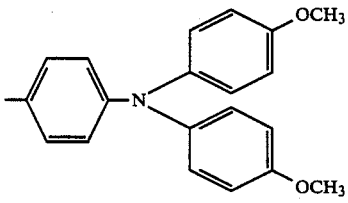 |
| XIV-16 | " | $-OCH_3$ | " | " | " | 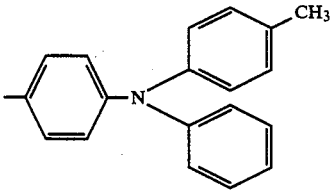 |

-continued
Exemplary compound group [XIV]:
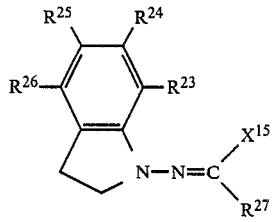
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-17 | " | —H | " | —Cl | " | 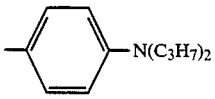 |
| XIV-18 | $-C_2H_5$ | " | " | —H | $-CH_3$ | 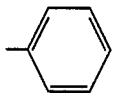 |
| XIV-19 | —H | " | " | " | 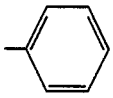 | 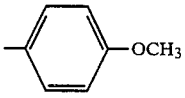 |
| XIV-20 | " | " | " | " | $-C_2H_5$ | 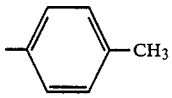 |
| XIV-21 | " | " | " | " | 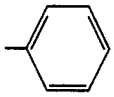 | 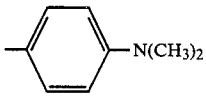 |
| XIV-22 | —H | —H | —H | —H | $-CH_3$ | 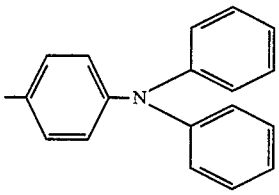 |
| XIV-23 | " | " | " | " | —H | 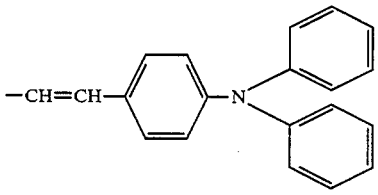 |
| XIV-24 | " | " | " | " | " | 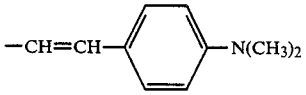 |
| XIV-25 | " | " | " | " | " | 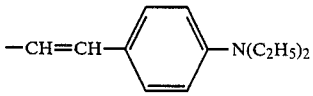 |

-continued
Exemplary compound group [XIV]:
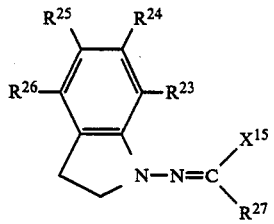
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-26 | " | " | " | " | " | 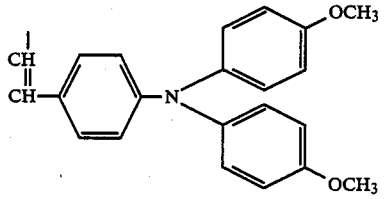 |
| XIV-27 | " | " | " | " | $-CH_3$ | 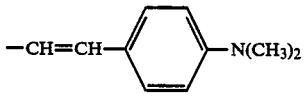 |
| XIV-28 | " | " | " | " | " | 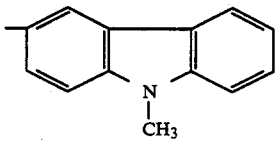 |
| XIV-29 | " | " | " | " | " | 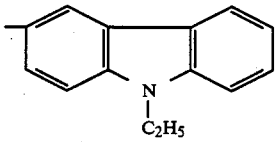 |
| XIV-30 | $-H$ | $-H$ | $-H$ | $-H$ | $-H$ | 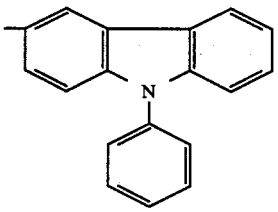 |
| XIV-31 | " | " | " | " | " | 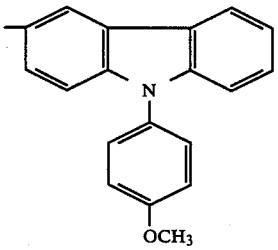 |

-continued
Exemplary compound group [XIV]:
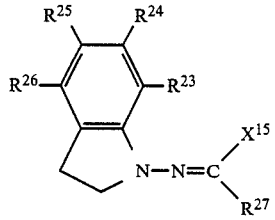
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-32 | " | " | " | " | " | 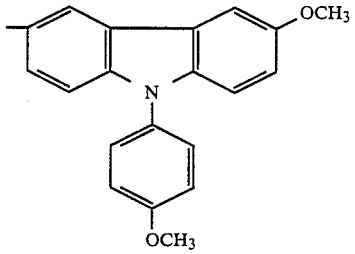 |
| XIV-33 | " | " | $-CH_3$ | " | " | 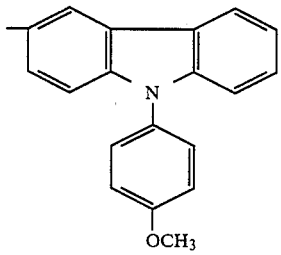 |
| XIV-34 | " | " | " | " | " | 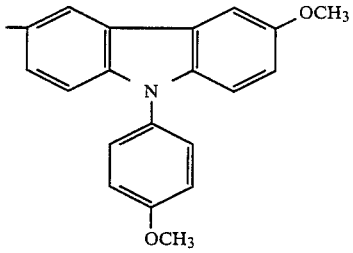 |
| XIV-35 | " | " | $-H$ | " | " | 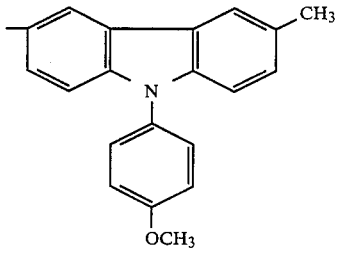 |
| XIV-36 | $-H$ | $-CH_3$ | $-H$ | $-H$ | $-H$ | 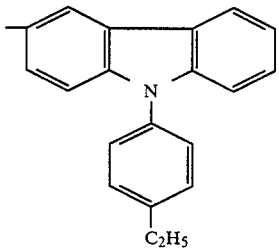 |

-continued
Exemplary compound group [XIV]:
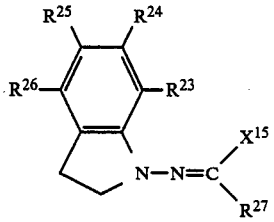
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-37 | " | —H | " | " | " | 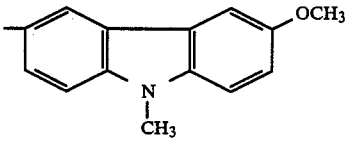 |
| XIV-38 | " | " | " | " | " | 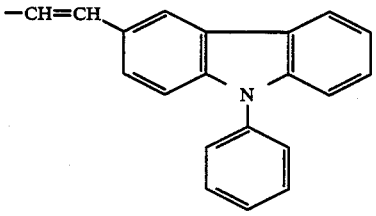 |
| XIV-39 | " | " | " | " | " | 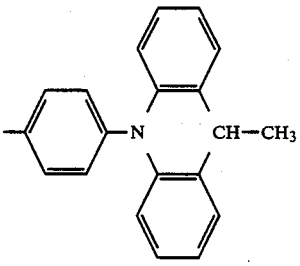 |
| XIV-40 | $-N(CH_3)_2$ | " | " | " | " | 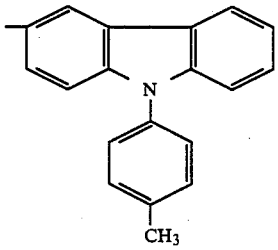 |
| XIV-41 | —H | —H | —H | —H | —H | 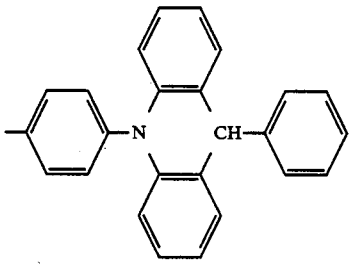 |

-continued
Exemplary compound group [XIV]:
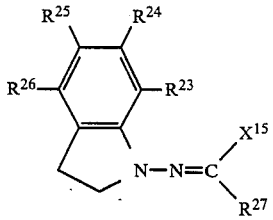
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-42 | " | " | " | " | " | 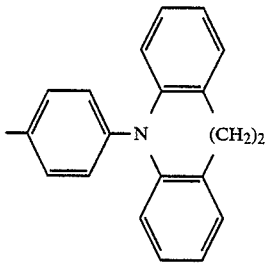 |
| XIV-43 | " | " | " | " | " | 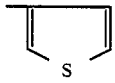 |
| XIV-44 | " | " | " | " | " | 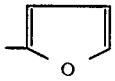 |
| XIV-45 | " | " | " | " | " | 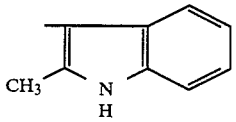 |
| XIV-46 | " | " | " | " | " | 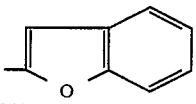 |
Exemplary compound group [XV]:
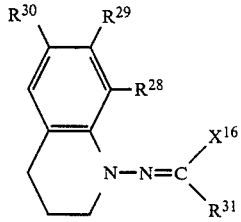
| Compound No. | $-R^{28}$ | $-R^{29}$ | $-R^{30}$ | $-R^{31}$ | $-X^{16}$ |
|---|---|---|---|---|---|
| XV-1 | —H | —H | —H | —H | 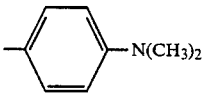 |
| XV-2 | " | " | " | " | 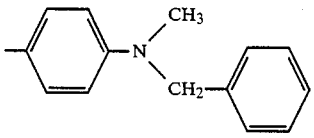 |

-continued
Exemplary compound group [XV]:
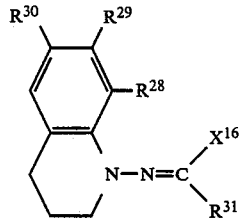
| | | | | | |
|---|---|---|---|---|---|
| XV-3 | " | " | —$CH_3$ | —H | 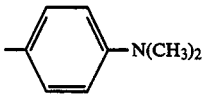 |
| XV-4 | " | " | —H | " | " |
| XV-5 | " | " | " | " | 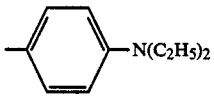 |
| XV-6 | " | —$OCH_3$ | " | " | " |
| XV-7 | " | —H | " | " | 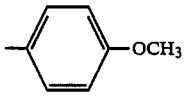 |
| XV-8 | " | " | " | " | 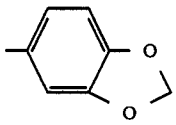 |
| XV-9 | —H | —H | —H | —H | 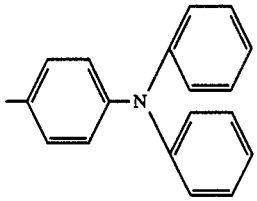 |
| XV-10 | " | " | " | " | 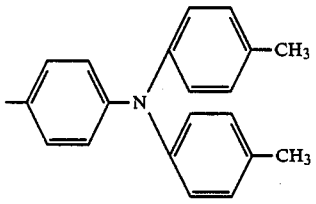 |
| XV-11 | " | " | " | " | 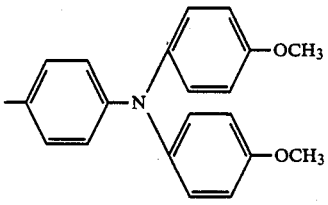 |

-continued
Exemplary compound group [XV]:
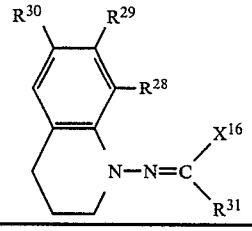
| | | | | | |
|---|---|---|---|---|---|
| XV-12 | " | " | —$CH_3$ | " | 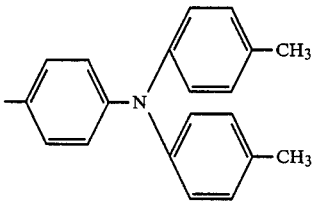 |
| XV-13 | " | " | —$OCH_3$ | " | 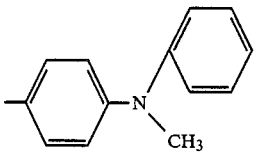 |
| XV-14 | " | " | —Cl | " | 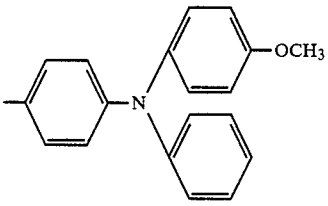 |
| XV-15 | " | " | —H | 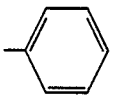 | 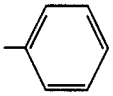 |
| XV-16 | " | " | " | " | 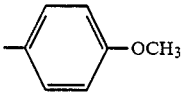 |
| XV-17 | —H | —H | —H | —$CH_3$ | 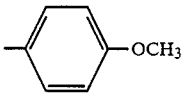 |
| XV-18 | " | " | " | " | 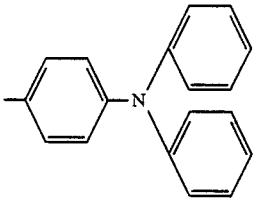 |
| XV-19 | " | " | " | 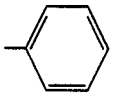 | 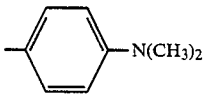 |

-continued
Exemplary compound group [XV]:
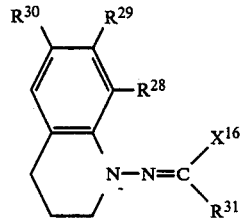
| | | | | | |
|---|---|---|---|---|---|
| XV-20 | " | " | " | —H | 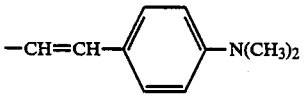 |
| XV-21 | " | " | " | " | 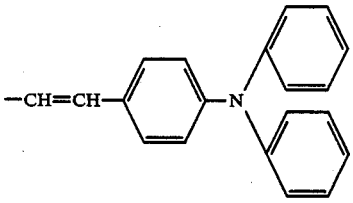 |
| XV-22 | —$CH_3$ | " | " | " | 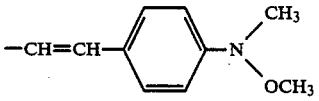 |
| XV-23 | —H | " | " | —$CH_3$ | 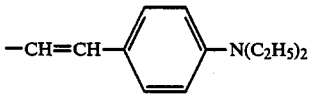 |
| XV-24 | " | " | " | —H | 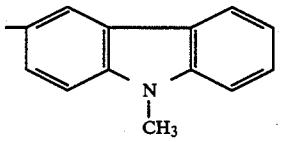 |
| XV-25 | " | " | " | " | 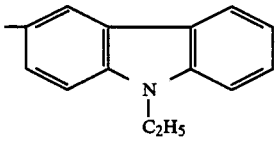 |
| XV-26 | —H | —H | —H | —H | 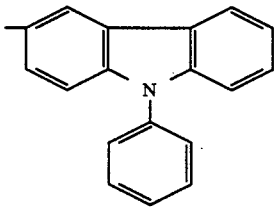 |
| XV-27 | " | " | —$CH_3$ | " | 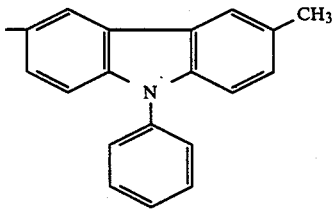 |

-continued
Exemplary compound group [XV]:
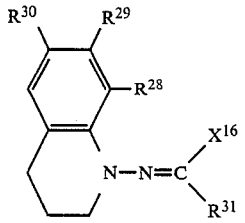
| | | | | | |
|---|---|---|---|---|---|
| XV-28 | " | " | —H | " | 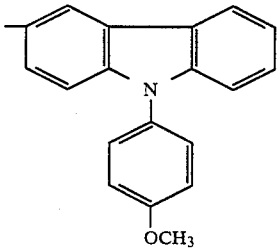 |
| XV-29 | " | " | —$CH_3$ | " | 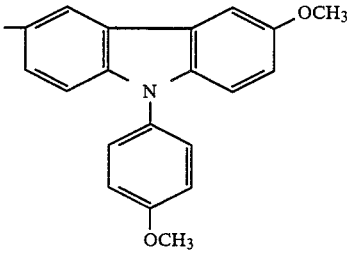 |
| XV-30 | " | " | —H | " | 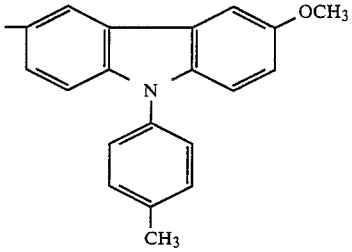 |
| XV-31 | " | " | " | " | 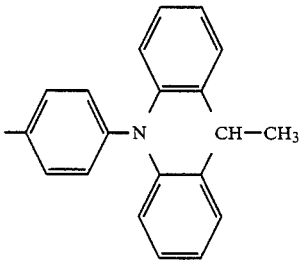 |
| Compound No. | —$R^{28}$ | —$R^{29}$ | —$R^{30}$ | —$R^{31}$ | —$X^{15}$ |
|---|---|---|---|---|---|
| XV-32 | —H | —H | —H | —H | 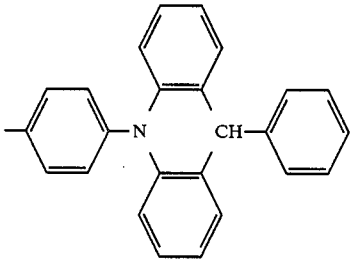 |

-continued
Exemplary compound group [XV]:
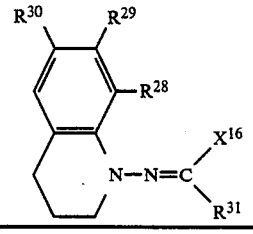
| | | | | | |
|---|---|---|---|---|---|
| XV-33 | " | " | " | " | 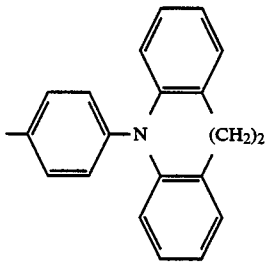 |
| XV-34 | " | " | " | " | 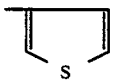 |
| XV-35 | " | " | —CN | " | 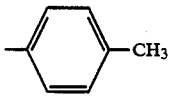 |
| XV-36 | " | —N($C_2H_5$)$_2$ | —H | " | 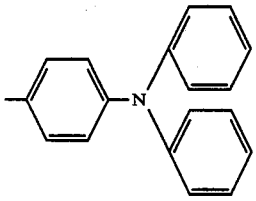 |
| XV-37 | —$C_2H_5$ | —H | " | " | 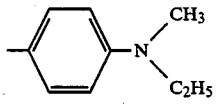 |
| XV-38 | —H | " | " | " | 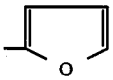 |
| Compound No. | —$R^{28}$ | —$R^{29}$ | —$R^{30}$ | —$R^{31}$ | —$X^{16}$ |
|---|---|---|---|---|---|
| XV-39 | —H | —H | —H | —H | 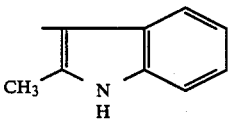 |
| XV-40 | " | " | " | " | 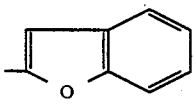 |

-continued
Exemplary compound group [XV]:
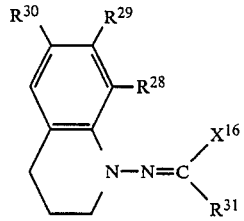
| | | | | | |
|---|---|---|---|---|---|
| XV-41 | " | " | " | " | 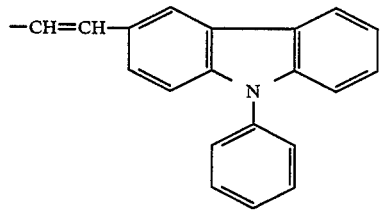 |
| XV-42 | $-C_3H_7$ | " | " | $-CH_3$ | 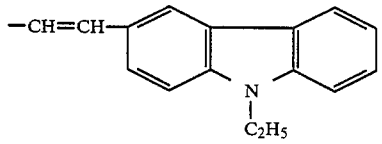 |
Pyrazoline compounds shown below as exemplary compound group [XVI] are also useful as CTM.
Exemplary compound group [XVI]:
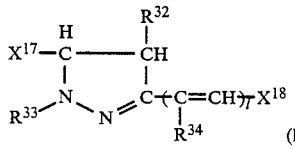
(l = 0 or 1)
| Compound No. | $-X^{17}$ | $-R^{32}$ | $-R^{33}$ | $-R^{34}$ | l | $-X^{18}$ |
|---|---|---|---|---|---|---|
| XVI-1 | 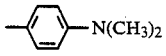 | $-CH_3$ | 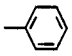 | $-H$ | 1 | 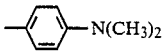 |
| XVI-2 | " | $-H$ | " | $-CH_3$ | " | " |
| XVI-3 | 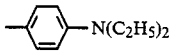 | $-CH_3$ | " | " | " | 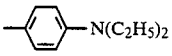 |
| XVI-4 | 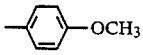 | " | " | $-H$ | " | 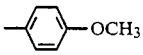 |
| XVI-5 | " | $-H$ | " | $-CH_3$ | " | " |
| XVI-6 | 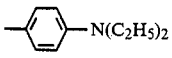 | $-CH_3$ | 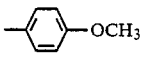 | $-H$ | " | 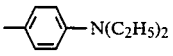 |
| XVI-7 | 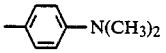 | " | 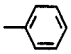 | " | " | 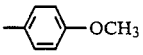 |
| XVI-8 | 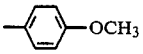 | " | " | " | " | 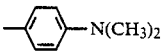 |
| XVI-9 | 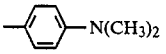 | $-H$ | " | $-CH_3$ | " | 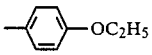 |

-continued

Exemplary compound group [XVI]:

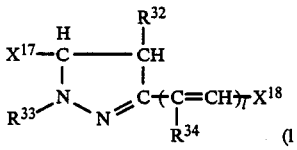

(l = 0 or 1)

| Compound No. | $-X^{17}$ | $-R^{32}$ | $-R^{33}$ | $-R^{34}$ | l | $-X^{18}$ |
|---|---|---|---|---|---|---|
| XVI-10 | $-C_6H_4-OC_2H_5$ | $-H$ | $-C_6H_5$ | $-CH_3$ | 1 | $-C_6H_4-N(C_2H_5)_2$ |
| XVI-11 | $-C_6H_4-N(C_2H_5)_2$ | $-C_6H_5$ | " | $-C_6H_5$ | " | $-C_6H_4-N(C_2H_5)_2$ |
| XVI-12 | $-C_6H_4-N(CH_3)_2$ | $-CH_3$ | " | $-H$ | " | $-C_6H_4-N(CH_2-C_6H_5)_2$ |
| XVI-13 | $-C_6H_4-N(C_2H_5)_2$ | " | " | $-H$ | 0 | $-C_6H_4-N(C_2H_5)_2$ |
| XVI-14 | " | $-C_2H_5$ | " | " | 1 | " |
| XVI-15 | $-C_6H_4-N(C_4H_9)_2$ | $-H$ | " | $-C_3H_7$ | " | $-C_6H_4-OC_2H_5$ |
| XVI-16 | $-C_6H_4-N(C_2H_5)_2$ | $-CH_2-C_6H_5$ | $-C_6H_4-OC_2H_5$ | $-H$ | " | $-C_6H_4-N(C_2H_5)_2$ |
| XVI-17 | " | $-H$ | $-C_6H_5$ | $-CH_2-C_6H_5$ | " | " |
| XVI-18 | $-C_6H_4-N(CH_3)_2$ | " | " | $-CH_3$ | " | $-C_6H_4-N(C_6H_5)_2$ |
| XVI-19 | $-C_6H_4-N(C_2H_5)_2$ | $-CH_3$ | " | $-H$ | " | $-C_6H_4-N(C_2H_5)_2$ |

Exemplary compound group [XVI]:

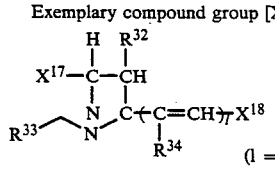

(l = 0 or 1)

| Compound No. | $-X^{17}$ | $-R^{32}$ | $-R^{33}$ | $-R^{34}$ | l | $-X^{18}$ |
|---|---|---|---|---|---|---|
| XVI-1 | $-C_6H_4-N(CH_3)_2$ | $-CH_3$ | $-C_6H_5$ | $-H$ | 1 | $-C_6H_4-N(CH_3)_2$ |
| XVI-2 | " | $-H$ | " | $-CH_3$ | " | " |
| XVI-3 | $-C_6H_4-N(C_2H_5)_2$ | $-CH_3$ | " | " | " | $-C_6H_4-N(C_2H_5)_2$ |
| XVI-4 | $-C_6H_4-OCH_3$ | " | " | $-H$ | " | $-C_6H_4-OCH_3$ |
| XVI-5 | " | $-H$ | " | $-CH_3$ | " | " |

-continued

Exemplary compound group [XVI]:

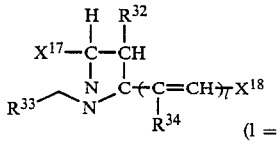

(l = 0 or 1)

| Compound No. | $-X^{17}$ | $-R^{32}$ | $-R^{33}$ | $-R^{34}$ | l | $-X^{18}$ |
|---|---|---|---|---|---|---|
| XVI-6 | $-C_6H_4-N(C_2H_5)_2$ | $-CH_3$ | $-C_6H_4-OCH_3$ | $-H$ | " | $-C_6H_4-N(C_2H_5)_2$ |
| XVI-7 | $-C_6H_4-N(CH_3)_2$ | " | $-C_6H_5$ | " | " | $-C_6H_4-OCH_3$ |
| XVI-8 | $-C_6H_4-OCH_3$ | " | " | " | " | $-C_6H_4-N(CH_3)_2$ |
| XVI-9 | $-C_6H_4-N(CH_3)_2$ | $-H$ | " | $-CH_3$ | " | $-C_6H_4-OC_2H_5$ |
| XVI-10 | $-C_6H_4-OC_2H_5$ | $-H$ | $-C_6H_5$ | $-CH_3$ | 1 | $-C_6H_4-N(C_2H_5)_2$ |
| XVI-11 | $-C_6H_4-N(C_2H_5)_2$ | $-C_6H_5$ | " | $-C_6H_5$ | " | $-C_6H_4-N(C_2H_5)_2$ |
| XVI-12 | $-C_6H_4-N(CH_3)_2$ | $-CH_3$ | " | $-H$ | " | $-C_6H_4-N(CH_2-C_6H_5)_2$ |
| XVI-13 | $-C_6H_4-N(C_2H_5)_2$ | " | " | $-H$ | 0 | $-C_6H_4-N(C_2H_5)_2$ |
| XVI-14 | " | $-C_2H_5$ | " | " | 1 | " |
| XVI-15 | $-C_6H_4-N(C_4H_9)_2$ | $-H$ | " | $-C_3H_7$ | " | $-C_6H_4-OC_2H_5$ |
| XVI-16 | $-C_6H_4-N(C_2H_5)_2$ | $-CH_2-C_6H_5$ | $-C_6H_4-OC_2H_5$ | $-H$ | " | $-C_6H_4-N(C_2H_5)_2$ |
| XVI-17 | " | $-H$ | $-C_6H_5$ | $-CH_2-C_6H_5$ | " | " |
| XVI-18 | $-C_6H_4-N(CH_3)_2$ | " | " | $-CH_3$ | " | $-C_6H_4-N(C_6H_5)_2$ |
| XVI-19 | $-C_6H_4-N(C_2H_5)_2$ | $-CH_3$ | " | $-H$ | " | $-C_6H_4-N(C_2H_5)_2$ |

Amine derivatives shown below as exemplary compound group [XVII] are also useful as CTM.

Exemplary compound group [XVII]:
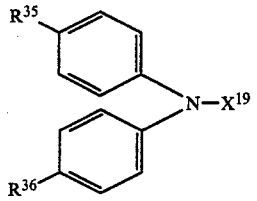
| Compound No. | $-R^{35}$ | $-R^{36}$ | $-X^{19}$ |
|---|---|---|---|
| XVII-1 | —H | —H | 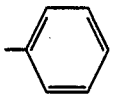 |
| XVII-2 | " | " | 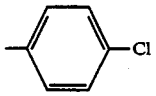  |
| XVII-3 | —Br | —Br | 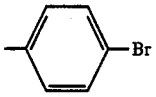  |
| XVII-4 | —H | —H | 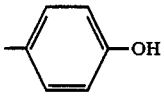  |
| XVII-5 | " | " | 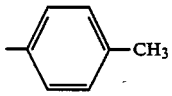  |
| XVII-6 | " | " | 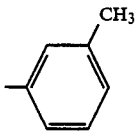  |
| XVII-7 | " | " | 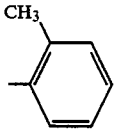  |
| XVII-8 | $-CH_3$ | —H | 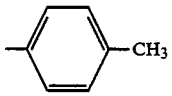  |
| XVII-9 | " | $-CH_3$ | " |
| XVII-10 | —H | —H | 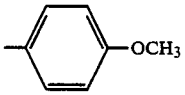  |
| XVII-11 | —H | —H | 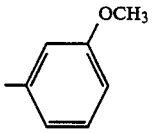  |

-continued
Exemplary compound group [XVII]:
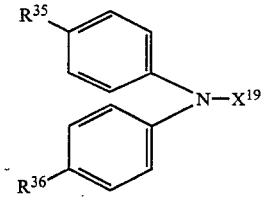
| Compound No. | $-R^{35}$ | $-R^{36}$ | $-X^{19}$ |
|---|---|---|---|
| XVII-12 | " | " | 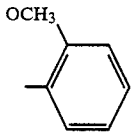 |
| XVII-13 | $-OCH_3$ | " | 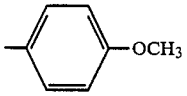 |
| XVII-14 | " | $-OCH_3$ | " |
| XVII-15 | $-CH_3$ | $-H$ | " |
| XVII-16 | $-H$ | " | 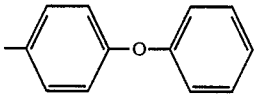 |
| XVII-17 | " | " | 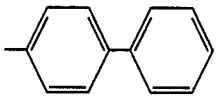 |
| XVII-18 | " | " | 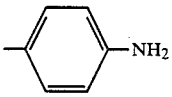 |
| XVII-19 | " | " | 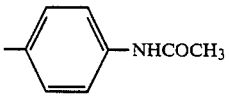 |
| XVII-20 | $-H$ | $-H$ | 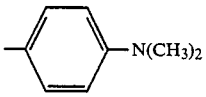 |
| XVII-21 | $-H$ | $-H$ | 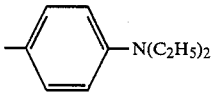 |
| XVII-22 | " | " | 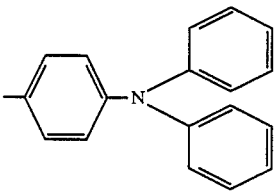 |
| XVII-23 | " | " | 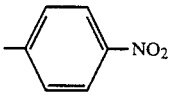 |

-continued
Exemplary compound group [XVII]:
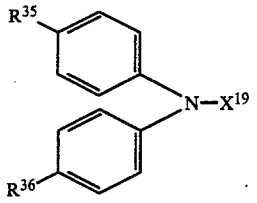
| Compound No. | $-R^{35}$ | $-R^{36}$ | $-X^{19}$ |
|---|---|---|---|
| XVII-24 | $-NO_2$ | " | 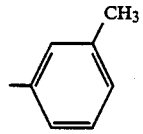 |
| XVII-25 | $-H$ | " | 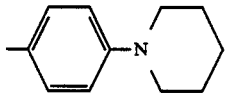 |
| XVII-26 | " | " | 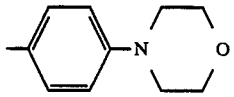 |
| XVII-27 | " | " | 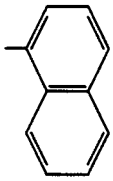 |
| XVII-28 | $-CH_3$ | $-CH_3$ | " |
| XVII-29 | $-H$ | $-H$ | 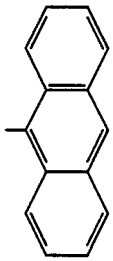 |
| XVII-30 | $-CH_3$ | $-CH_3$ | 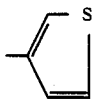 |
| XVII-31 | $-H$ | $-H$ | 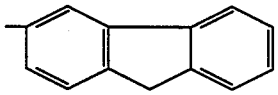 |
| XVII-32 | $-CH_3$ | $-CH_3$ | 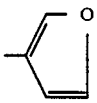 |

-continued

Exemplary compound group [XVII]:

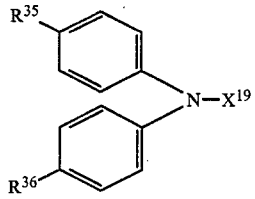

| Compound No. | $-R^{35}$ | $-R^{36}$ | $-X^{19}$ |
|---|---|---|---|
| XVII-33 | —H | —H | 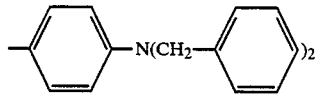 |

In a protection layer which may be provided according to the invention, a transparent resin material having a volume resistance of not less than $10^8$ Ω.cm, preferably not less than $10^{10}$ Ω.cm, and more preferably not less than $10^{13}$ Ω.cm, is used as a binder. The binder should contain at least 50% by weight of a photosetting or thermosettng resin.

Examples of such resin are thermosetting acrylic, silicon, epoxy, urethane, urea, phenolic, polyester, alkyd, and melamine resins, photosetting cinnamic resins, and copolymer or co-condensation polymer resins of these. In addition, all those photosetting or themosetting resins which are commonly used in electro photographic materials can be used for the above purpose. The protection layer may contain less than 50% by weight of a thermoplastic resin as required for purposes of processability and property improvement (for prevention of cracking, provision of flexibility, etc.). Examples of such thermoplastic resin are polypropylene, acrylic, methacrylic, vinyl chloride, vinyl acetate, epoxy, butyral, polycarbonate, and silicon resins, or copolymers of these resins, such as vinyl chloride vinyl acetate copolymer resins, and vinyl chloride vinyl acetate-maleic anhydride copolymer resins, also organic semiconducting polymers, such as poly-N-vinyl carbozole and the like. In addition, all those thermoplastic resins which are commonly used in electro-photographic materials.

The protection layer may also contain an electron receptive material, and may contain an ultraviolet absorber as required for protection of CGM. Such material, together with the binder, is dissolved in a solvent, which is coated by, for example, dip coating, spray coating, blade coating, or roll coating, the coat being dried to a thickness of not more than 2 μm, preferably not more than 1 μm.

The photoreceptive layer of the photoreceptor according to the invention may be either a laminated layer structure or a single layer structure, and the charge transport layer, the charge generating layer, or the protection layer may contain one or more kinds of electron receptive materials for purposes of sensitivity improvement, and recidual potential reduction or fatigue reduction during repeated use.

Examples of electron receptive materials useful for the purpose of the invention are succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyano quinodimethane, o-dinitrobenzene, m-dinitrobenzene, 1,3,5,-trinitrobenzene, paranitrobenzonitrile, picrilochloride, quinone chlorimide, chloranil, bulmanyl, 2-methyl naphthoquinone, dichlorodicyano parabenzoquinone, anthraquinone, dinitro anthranquinone, trinitrofluorenone, 9-fluorenilidene [dicyanomethylene malonodinitrile], polynitro-9-fluorenilidene-[dicyanomethylene malonodinitrile], piric acid, o-nitrobenzoic acid, p-nitrobenzoic acid, 3,5-dinitrobenzoic acid, pentafluorobenzoic acid, 5-salicylic acid, 3,5-dinitrosalicylic acid, and phthalic acid.

Examples of binder resins useful for formation of the photoreceptive layer according to the invention are addition polymer type, polyaddition polymer type, and polycondensation polymer type resins, such as polyethylenes, polypropylenes, acrylics, methacrylics, vinyl chloride resins, vinyl acetate resins, epoxy resins, polyurethane resins, phenolics, polyesters alkyd resins, polycarbonates, silicon resins, and melamine resins, and copolymer resins containing two or more of the repeating units of these resins, such as vinyl chloride-vinyl acetate, and vinyl chloride-vinyl acetate-maleic anhydride. Besides these insulating resins, organic semiconducting polymers, such as poly-N-vinyl carbazole and the like, may be mentioned. For the photoconductive base which supports the photoconductive layer, a metallic plate, drum, or foil of such material as aluminum or nickel, a plastic film deposited with aluminum, tin oxide, iridium, or the like, or a photoconductive material coated paper, plastic film, or drum may be used.

The charge transporting layer is formed by coating a liquid prepared by dissolving or dispersing CTM alone or together with a suitable binder in a suitable solvent, then drying the coat.

Examples of solvents useful in connection with forming of CTL are N,N-dimethyl formamide, benzene, toluene, xylene, monochlorobenzene, 1,2-dichloroethane, dichloromethane, 1,1,2-trichloroethane, tetrahydrofuran, methyl ethyl ketone, ethyl acetate, and butyl acetate.

The thickness of CTL as formed is preferably 5 to 50 μm, especially preferably 5 to 30 μm.

The amount of CTM loaded in CTL is 20~200 parts by weight, preferably 30~200 parts by weight per 100 parts by weight of the binder resin.

If the CTM content is smaller than above said lower limit, no good photosensitivity is obtainable, with the result of increased residual potential, and if the CTM content is greater than above said upper limit, the result is decreased solubility in the solvent medium.

The charge generating layer may be formed in same manner as CTL, namely, by coating a liquid prepared by dissolving or dispersing CGM and CTM separately or together in a suitable solvent, either independently or together with a suitable binder, then drying the coat.

When dispersing the CGM in forming the CGL, it is desirable that the CGM is reduced to a particulate mass having a particle diameter of not more than 2 μm, preferably not more than 1 μm. If the particle diameter is too large, no satisfactory particle dispersion in the layer is obtainable, and sometimes particles may project from the surface of the layer, the surface smoothness of the layer being thus affected, which may invite local deposition of toner particles, thus causing toner filming.

However, if the particle diameter is too small, particles may have a chance to aggregate, which may eventually lead to increased layer resistance, defective crystallization, decreased sensitivity, or lowered repeatability. Preferably, therefore, the lower limit of the particle size should be 0.01 μm.

The charge generating layer may be provided in the following way. The CGM is reduced to fine particles in a dispersion medium by means of a ball mill or a homomixer, then a binder resin and CTM are added, followed by mixing and dispersing. The resulting dispersion is coated, whereby the required CGL is obtained. In this method, uniform dispersion can be obtained by dispersing particles under the action of ultrasonic wave.

The amount of CGM loaded in the CGL is 20~200 parts by weight, preferably 25~100 parts by weight, per 100 parts by weight of the binder resin, and that of CTM is 20~200 parts by weight, preferably 30~150 parts by weight.

If the amount of CGM is less than above said lower limit, no satisfactory photosensitivity is obtainable, with the result of increased residual potential, and if the amount of CGM is greater than above said upper limit, the result is increased darkdecay and decreased potential receptivity.

The thickness of the CGL formed in manner as above described is preferably 1~10 μm, especially preferably 2~7 μm.

Where the photoreceptive layer is of a laminated structure, the thickness ratio of CGL to CTL is preferably 1:(1~30).

Where the photoreceptive layer is of a single layer structure, the amount of the charge generating material in the layer, 20~200 parts by weight, preferably 25~100 parts by weight, per 100 parts by weight of the binder resin.

If the amount of the charge generating material is smaller than above said lower limit, no satisfactory photosenitivity is obtainable, with the result of increased residual potential, and if the amount is greater than above said upper limit, the result is increased darkdecay and decreased potential receptivity.

The proportion of the charge transporting material in relation to the binder resin is 20~200 parts by weight, preferably 30~150 parts by weight, per 100 parts by weight of the binder resin.

If the proportion of the charge transporting material is smaller than said lower limit, no satisfactory photosensitivity is obtainable, with the result of increased residual potential, and if the proportion is greater than said upper limit, the result is decreased solubility in the solvent medium.

In the photoreceptive layer of said single layer construction, the weight ratio of the charge generating material to the charge transporting material is preferably 1:3~1:1.

[EXAMPLES]

The following examples are given to further illustrate the invention, but it is to be understood that the mode of carrying out the invention is not limited by the examples.

EXAMPLE 1

A 0.1 μm thick intermediate layer composed of a vinyl chloride-vinyl acetate-maleic anhydride copolymer ("Esleck MF-10, produced by Sekisui Chemical Co.) was formed on a photoconductive base comprised of an aluminum-foil laminated polyester film.

A 1,2-dichloroethane solution containing 16.5 wt % of a mixture of polycarbonate resin ("Panlite L-1250", produced by Teijin Kasei)/CTM(IX-75)=100/75 (weight ratio) was dip coated on the intermediate layer, whereby a charge transport layer having a thickness of 15 μm was formed. A mixture of sublimated 4,10-dibromoanthanthrone (VI-3)/"Panlite L-1250=½ weight ratio), as CGM, was pulverized by a ball mill for 24 hours, in a solution of 1,2-dichloroethane of such proportion that the CGM was measured at 9 wt %. Further, the pulverized CGM was dispersed in the solution for 24 hours. To the dispersion was added CTM(IX-75) in a proportion of 75 wt % to the Panlite L-1250, and the exemplary compound (3) in a proportion of 10 wt % to the CTM. Monochlorobenzene was added to the resulting solution so that the ratio of 1,2-dichlorobenzene/monochlorobenzene=7/3 (volume ratio) was reached. The dispersion thus prepared was spray coated on the CTL, then the coat was dried, whereby a charge generating layer having a thickness of 5 m was formed. Thus, a photoreceptor of laminated construction according to the invention was obtained.

COMPARATIVE EXAMPLE 1

A reference photoreceptor was obtained in same manner as in Example 1, except that the exemplary compound (3) was used in Example 1 was excluded.

EXAMPLE 2

A photoreceptor was produced in same way as in Example 1, except that exemplary compound (12) was used in place of exemplary compound (3)

A coating liquid obtained by dissolving 1.55 parts by weight of a thermosetting acrylic-melamine-epoxy (1:1:1) resin and 0.155 part by weight of exemplary compound (3) in a mixture solvent medium of monochlorobenzene/1,1,2-trichloroethane was spray coated on a photoreceptor of same construction as Example 1 photoreceptor except that exemplary 3 compound was excluded (same as the Comparative Example 1 photoreceptor), and the coat was dried. Thus, a photoreceptor having a 1 μm thick protection layer was obtained.

EXAMPLE 4

On a photoreceptor which was of same construction as example 1 photoreceptor except that exemplary 3 compound was excluded was spray coated silicon hard coat primer PH91 (a product of Toshiba Silicon Co.), and further thereon was spray coated a solution prepared by adding "Silicon Hardcoat Tosguard 510" (a product of Toshiba Silicon Co.) and exemplary compound (3) to a base resin in the proportion of 10 parts by weight in relation to 100 parts by weight of the resin. The coat was dried to give a protective layer having a thickness of 1 μm. Thus, a photoreceptor was obtained.

EXAMPLE 5

A 0.1 μm thick intermediate layer composed of a vinyl chloride-vinyl acetate-maleic anhydride copolymer ("Esleck MF-10, produced by Sekisui Chemical Co.) was formed on a photoconductive base comprised of an aluminum-foil laminated polyester film.

A coating liquid for CTL prepared by dissolving 8 wt % of a butyral resin ("Esleck BX-1, produced by Sekisui Chemical Co.) and 6 wt % of CTM(IX-75) in methyl ketone was coated on the intermediate layer, and the coat was dried, whereby a charge transport layer having at thickness of 10 μm was formed. In a paint conditioner (made by Red Devil), 0.2 g of CGM(IV-7) was pulverized for 30 minutes, to which was added 8.3 g of a solution prepared by dissolving 0.5 wt % of a policarbonate resin ("Panlite L-1250, produced by Teijin Kasei) in a mixture solvent medium of 1,2-dichloroethane/1,1,2-trichloroethane, and the pulverized CGM was dispersed in the solution for 3 minutes. To the dispersion was added 19.1 g of a solution obtained by dissolving 3.3 wt % of polycarbonate resin, 2.6 wt % of CTM(IX-75), and 0.26 wt % of exemplary compound (3) in a mixed solvent medium of 1,2-dichloroethane/1,1,2-trichloroethane, and the CGM was further dispersed for 30 minutes. The dispersion thus obtained was spray coated on the CTL, and the coat was dried, whereby a charge generating layer having a thickness of 5 μm was formed. Thus, a photoreceptor having a photoreceptive layer of laminated construction was obtained.

COMPARATIVE EXAMPLE

A reference photoreceptor was obtained in same manner as in Example 5, except that the exemplary compound (3) used in Example 5 was excluded.

EXAMPLE 6

A photoreceptor was obtained in same was as in Example 5, except that exemplary compound (12) was used in place of exemplary compound (3).

EXAMPLE 7

A protection layer containing exemplary compound (3) which is of same construction as that of Example 4 was placed on a photoreceptive layer which is of same construction as the Example 5 photoreceptive layer except that the exemplary compound (3) was excluded (same as the Comparative Example 2 photoreceptor). Thus, a photoreceptor was obtained.

EXAMPLE 8

A hard coat layer of the same construction as in Example 4 containing exemplary Compound (3) was formed on a photoreceptive layer which is of same construction as the Example 5 photoreceptive layer except that the exemplary compound (3) was excluded. A photoreceptor was thus obtained.

The photoreceptor samples obtained as above were tested by an ozone fatigue tester of the type shown below for evaluation of their resistance to ozone. A static tester (Model SP-428, manufactured by Kawaguchi Denki Seisakusho) was employed, with an ozone generator (Model 0-1-2, manufactured by Nippon Ozone K.K.) and an ozone monitor (Model EG-2001, manufactured by Ebara Jitsugyo K.K.), both of which were mounted to the static tester. Each photoreceptor was mounted in position at an ozone concentration of 90 ppm; then a voltage of +6 KV was applied and the photoreceptive layer was electrified by corona discharge for 5 seconds. After being allowed to stand for 5 seconds (the potential at which time was taken as initial potential $V_0$), the photoreceptive layer was exposed to light illumination from a tungsten lamp so that the illuminance on its surface was 14 lux. This procedure was repeated 100 times.

Where the potential after illumination 100 times was V, the resistance to ozone of the photoreceptive layer was expressed by $V/V_0 \times 100(\%)$. $V/V_0$ indicates the degree of potential decrease after 100-time repeated illumination, and therefore the greater the $V/V_0$ value, the better.

Without ozone introduction, the amount of exposure E (lux/sec) required in decaying the initial potential from +600 V to +100 V was measured. The smaller the value, the higher is the sensitivity. The results are shown in Table 1.

TABLE 1

| Photoreceptor | CGM | CTM | Exemplary compound | $V/V_0 \times 100$ (%) | E (lux/sec) |
|---|---|---|---|---|---|
| Example 1 | VI-3 | IX-75 | (3) | 85 | 6.0 |
| Comp Example 1 | " | " | — | 50 | 5.9 |
| Example 2 | " | " | (12) | 86 | 6.1 |
| Example 3 | " | " | (3) | 90 | 7.0 |
| Example 4 | " | " | " | 91 | 6.5 |
| Example 5 | VI-7 | " | " | 80 | 5.5 |
| Example 2 | " | " | — | 45 | 5.4 |
| Example 6 | " | " | (12) | 81 | 5.6 |
| Example 7 | " | " | (3) | 88 | 6.5 |
| Example 8 | " | " | " | 90 | 6.0 |

It can be seen from Table 1 that all the photoreceptors of the invention showed good advantage over the comparative example photoreceptors in both ozone resistance and electrophotographic characteristics.

EXAMPLE 9

A 0.1 μm thick intermediate layer composed of a vinyl chloride-vinyl acetate maleic anhydride copolymer ("Esleck MF-10", produced by Sekisui Chemical Co.) was formed on a photoconductive base comprised of an aluminum cylinder.

A 1,2-dichloroethane solution containing 16.5 wt % of a mixture of CTM(IX-75)/polycarbonate resin (Panlite L-1250, produced by Teijin Kasei)=75/100 (weight ratio) was dip coated on the intermediate layer, and the coat was coated, whereby a CTL having a thickness of 15 μm was obtained.

A mixture of sublimated 4,10-dibromoanthanthrone (VI-3)/Panlite L-1250=50/100 (weight ratio ), as CGM, was pulverized in a ball mill for 24 hours, then 1,2-dichloroethane was added so that the CGM was measured at 9 wt %, and the CGM was further dispersed in the ball mill for 24 hours. To the solution in which the CGM was dispersed were added 75 wt % of CTM (IX-75) relative to the Panlite L-1250, and 10 wt % of 2,2'-methylene bis (6-t-butyl-4-methylphenol), as an antioxidizing agent, relative to the CTM. Monochlorobenzene was added to the resulting dispersion so that a ratio of monochlorobenzene/1,2-dichloroethane=3/7 (volume ratio) was reached. The coating liquid thus prepared was spray coated on the CTL, whereby a CGL having a thickness of 5 μm was formed. Thus, a photoreceptor according to the invention was obtained.

COMPARATIVE EXAMPLE 3

A reference photoreceptor was obtained in same manner as in Example 9, except that the 2,2'-methylene bis (6-t-butyl-4-methyl phenol) in the CGL was excluded.

EXAMPLE 10

The procedure of Example 9 was followed, except that dilauryl-3,3'-thiodipropionate was added in place of the 2,2'-methylene bis (6-t-butyl-4-methyl phenol) in Example 9.

COMPARATIVE EXAMPLE 4

The procedure of Example 9 was followed, except that the thickness of the CGL was 1 μm.

COMPARATIVE EXAMPLE 5

The procedure of Example 9 was followed, except that the thickness of the CGL was 10 μm.

COMPARATIVE EXAMPLE 6

The procedure of Example 9 was followed, except that the CTM and the 2,2'-methylene bis (6-t-butyl-4-methyl phenol) in Example 9 were excluded.

EXAMPLE 11

A 0.1 μm thick intermediate layer composed of a vinyl chloride-vinyl acetate-maleic anhydride copolymer ("Esleck MF-10", produced by Sekisui Chemical Co.) was formed on a photoconductive base comprised of an aluminum cylinder.

A coating liquid for CTL coating obtained by dissolving 8 wt % of butyral resin ("Esleck BX-1", produced by Sekisui Chemical Co.) and 6 wt % of CTM (IX-75) in methyl ethyl ethyl ketone was coated on the intermediate layer, and the coat was dried, whereby a charge transport layer having a thickness of 10 μm was formed. In a paint conditioner (made by Red Devil), 0.2 g of CGM (IV-7) was pulverized for 30 minutes, to which was added 8.3 g of a solution prepared by dissolving 0.5 wt % of a policarnonate resin ("Panlite L-1250", produced by Teijin Kasei) in a mixture solvent medium of 1,2-dichloroethane/1,1,2-trichloroethane, and the pulverized CGM was dispersed in the solution for 3 minutes. To the dispersion was added 19.1 g of a solution obtained by dissolving 3.3 wt % of polycarbonate resin, 2.6 wt % of CTM (IX-75), and 0.26 wt % of 2,2'-methylene bis (6-t-butyl-4-methyl phenol) in a mixed solvent medium of 1,2-dichloroethane/1,1,2-trichloroethane, and the CGM was further dispersed for 30 minutes. The dispersion thus obtained was spray coated on the CTL, and the coat was dried, whereby a charge generating layer having a thickness of 5 μm was formed. Thus, a photoreceptor having a photoreceptine layer of laminated construction was obtained.

COMPARATIVE EXAMPLE 7

The procedure of Example 11 was followed, except that the 2,2'-methylene bis (6-t-butyl-4-methyl phenol) in CGL was excluded.

EXAMPLE 12

The procedure of Example 11 was followed, except that dilauryl-3,3'-thiodipropionate was added in place of the 2,2'-methylene bis (6-t-butyl-4-methyl phenol) in Example 11.

Each of the photoreceptors obtained as above was mounted in a remodelled U-Bix 2812MR machine (made by Konishiroku Photo Industry Co.), and at a controlled ozone concentration of 10 ppm and after a cycle of positive charging→developing→transfer→cleaning was repeated 10,000 times, the surface potential (black paper potential, Vb) of the photoreceptor was measured. Further, by said copying machine were made measurements of initial potential (E) and, without ozone introduction, the amount of exposure as required in decaying the potential from the initial potential of +600 V to +100 V.

The results are shown in Table 2.

TABLE 2

| Photo-receptor | CGM | CTM (in CGL) | Antioxidizing agent | $\Delta Vb^{0\ 10000}$ (V) | Initial E (lux/sec) |
|---|---|---|---|---|---|
| Example 9 | VI-3 | IX-75 | 2,2'-methylene bis (6-t-butyl-4-methyl phenol) | 50 | 4.9 |
| Comp Example 3 | " | " | — | 200 | 4.8 |
| Example 10 | " | " | dilauryl-3,3'-thio-dipropionate | 60 | 5.0 |
| Comp Example 4 | " | " | 2,2'-methylene bis (6-t-butyl-4-methyl phenol) | 70 | 8.0[a] |
| Comp Example 5 | " | " | 2,2'-methylene bis(6-t-butyl-4-methyl phenol) | 75 | 7.0[b] |
| Comp Example 6 | " | — | — | 150 | 20.0[c] |
| Example 11 | IV-7 | IX-75 | 2,2'-methylene bis (6-t-butyl-4-methyl phenol) | 80 | 4.5 |
| Comp Example 7 | " | " | — | 250 | 4.4 |
| Example 12 | " | " | dilauryl-3,3'-thio-dipropionate | 85 | 4.5 |

*Decrease in surface potential after 10,000-time repetition (initial potential 600 V)
[a]The CGL was so thin that sensitivity was low. Even though these was no decrease in potential, the CGL was considerably cut off, with the result that there was further deterioration in sensitivity.
[b]The CGL was so thick that sensitivity was low.
[d]Since the CGL had no CTM content, sensitivity was extremely low.

As is clear from Table 2, the use of a positive charge photoreceptor having a charge generating layer containing a charge transporting material and an antioxidizing agent provides satisfactory sensitivity and permits formation of good image with less drop in the potential.

EXAMPLE 13

A 0.1 μm thick intermediate layer composed of a vinyl chloride vinyl acetate maleic anhydride copolymer ("Esleck MF-10", produced by Sekisui Chemical Co.) was formed on a photoconductive base comprised of an aluminum cylinder.

A 1,2-dichloroethane solution containing 16.5 wt % of a mixture of CTM(IX-75)/polycarbonate resin (Panlite L-1250, produced by Teijin Kasei)=75/100 (weight ratio) was dip coated on the intermediate layer, and the coat was coated, whereby a CTL having a thickness of 15 μm was obtained.

A mixture of sublimated 4,10-dibromoanthanthrone (VI-3)/Panlite L-1250=50/100 (weight ratio), as CGM, was pulverized in a ball mill for 24 hours, then 1,2-dichloroethane was added so that the CGM was measured at 9 wt %, and the CGM was further dispersed in the ball mill for 24 hours. To the solution in which the CGM was dispersed were added 75 wt % of CTM (IX-75) relative to the Panlite L-1250. Monochlorobenzene was added to the resulting dispersion so that a ratio of monochlorobenzene/1,2-dichloroethane=3/7 (volume ratio) was reached. The coating liquid thus prepared was spray coated on the CTL, whereby a CGL having a thickness of 5 μm was formed.

Then, a coating liquid prepared by dissolving 1.55 parts by weight of a thermosetting acryl-melamine-epoxy (1:1:1) resin and 0.155 parts by weight of 2,2'-methylene bis (6-t-butyl-4-methyl phenol) in 100 parts by weight of a monochlorobenzene/1,1,2-trichloroethan mixture solvent medium was spray coated on the CGL, and the coat was dried, whereby a protection layer having a thickness of 1 μm was formed. Thus, a photoreceptor according to the invention was obtained.

COMPARATIVE EXAMPLE 8

A reference photoreceptor was obtained in same manner as in Example 13, except that the 2,2'-methylene bis(6-t-butyl-4-methyl phenol) in the protection layer was excluded.

EXAMPLE 14

A silicon hard coat primer PH91 (produced by Toshiba Silicon), in place of the OCL in Example 13, was spray coated so as to obtain a 0.1 μm thick coat, and a solution of a silicon hard coat Tosguard 510 (produced by Toshiba Silicon) loaded with 10 wt % of 2,2'-methylene bis (6-t-butyl-4-methyl phenol) was spray coated thereon, the coat being then dried, whereby an OCL having a thickness of 1 μm was formed. Thus, a photoreceptor was obtained.

COMPARATIVE EXAMPLE 9

The procedure of Example 14 was followed, except that the 2,2'-methylene bis (6-t-butyl-4-methyl phenol) in the OCL was excluded.

EXAMPLES 15~18

The procedure of Example 14 was followed, except that N-phenyl-N'-isopropyl-p-phenylene diamine, 2,5-di-t-octylhydroquinone, dilauryl-3,3'-thiodipropionate, and triphenyl phosphine were added respectively in place of the 2,2'-methylene bis (6-t-butyl0-4-methyl phenol) in Example 14.

COMPARATIVE EXAMPLE 10

The procedure of Example 14 was followed, except that the OCL in Example 13 was excluded.

COMPARATIVE EXAMPLE 11

The procedure of Example 14 was followed, except that the OCL in Example 13 and further the CTM in the CGL were excluded.

COMPARATIVE EXAMPLE 12

The procedure of Example 14 was followed, except that the CTM in the Example 13 CGL was excluded.

EXAMPLE 19

An intermediate layer, about 0.1 μm thick, composed of a vinyl chloride-vinyl acetate-maleic anhydride complymer ("Esleck MF-10, producer of which was already mentioned) was formed on a photoconductive base comprised of an aluminum cylinder.

A coating liquid for CTL prepared by dissolving 8 wt % of a butyral resin ("Esleck BX-1", produced by Sekisui Chemical Co.) and 6 wt % of CTM(IX-75) in methyl ethyl ketone was applied on the intermediate layer, and the coat was dried, whereby a charge transporting layer having a thickness of 10 μm was formed. Then, in a paint conditioner (made by Red Devil), 0.2 g of CGM(IV-7) was pulverized for 30 minutes, to which was added 8.3 g of a dry solution prepared by dissolving 0.5 wt % of a polycarbonate resin ("Panlite L-1250, producer of which was already mentioned) in a mixture solvent of 1,2-dichloroethane/1,1,2-trichloroethane, the CGM being dispersed in the dry solution for 3 minutes. To the resulting dispersion was added 19.1 g of a dry solution prepared by dissolving 3.3 wt % of a polycarbonate resin and 2.6 wt % of CTM(IX-75) in a mixture solvent medium, and the GTM was further dispersed for 30 minutes. The dispersion thus obtained was spray coated on the CTL, and the coat was dried, whereby a 5 μm thick charge generating layer was formed.

Subsequently, a coating liquid prepared by dissolving 1.55 parts by weight of a thermosetting acryl-melamine-epoxy (1:1:1) resin and 0.155 parts by weight of 2,2'-methylene bis(6-t-butyl-4-methyl phenol) in 100 parts by weight of a monochlorobenzene/1,1,2-trichloroethane mixture solvent was spray coated on the OGL, and the coat was dried, whereby a 1 μm thick protection layer was formed. Thus, photoreceptor according to the invention was obtained.

COMPARATIVE EXAMPLE 13

The procedure of example 19 was followed, except that the 2,2'-methylene bis (6-t-butyl-4-methyl phenol) in the OCL was excluded.

COMPARATIVE EXAMPLE 14

The procedure of example 19 was followed, except that the OCL in example 19 was excluded.

COMPARATIVE EXAMPLE 15

The procedure of example 19 was followed, except that the CTM in the example 19 CGL was excluded.

COMPARATIVE EXAMPLE 16

The procedure of example 19 was followed, except that the OCL in example 19 and the CTM in the CGL were excluded.

Each of the electro-photographic photoreceptors obtained as above described was mounted in a copying machine U-Bix 2812MR, remodelled (made by Konishiroku Photo Industry Co.) and, with ozone concentration controlled at 10 ppm, same was tested for measurement of the surface potential Vb (initial potential=600 V) after 10,000 time repetition of a cycle of positive charging→developing→transfer→cleaning. Further, by employing same copying machine, initial sensitivity $E_{100}^{600}$ (lux.sec) (quantity of exposure necessary for decaying from the initial potential +600 V to +100 V without ozone introduction. Results are shown in Table 3.

As in clear from Table 3, by using an antioxidizing agent in the protective layer and a photoreceptor having CTM in the CGL it is possible to obtain satisfactory results with high sensitivity and less potential drop.

TABLE 3

| Photo-receptor | CGM | CTM (in CGL) | Antioxidizing agent (in OCL) | $\Delta Vb^{0\ 10000}$ (V) | Initial E (lux/sec) |
|---|---|---|---|---|---|
| Example 13 | VI-3 | IX-75 | 2,2'-methylene bis (6-t-butyl-4-methyl phenol) | 30 | 6.5 |
| Comp Example 8 | " | " | — | 100 | 6.3 |
| Example 14 | " | " | 2,2'-methylene bis (6-t-butyl-4-methyl phenol) | 20 | 5.9 |
| Comp Example 9 | " | " | — | 105 | 5.7 |
| Example 15 | | | N—phenyl-N'—isopropyl-P—phenylenediamine | 25 | 6.2 |
| Example 16 | " | " | 2,5-di-t-octylhydro-quinone | 30 | 6.5 |
| Example 17 | " | " | dilauryl-3,3'-thio-dipropionate | 35 | 6.4 |
| Example 18 | " | " | triphenylphosphine | 33 | 6.7 |
| Comp Example 10 | " | " | without OCL | 170 | 5.1 |
| Comp Example 11 | " | — | " | 80 | 20.0 |
| Comp Example 12 | " | — | 2,2'-methylene bis (6-t-butyl-4-methyl phenol) | 30 | 22.0 |
| Example 19 | IV-7 | IX-75 | " | 40 | 6.0 |
| Comp Example 13 | " | " | — | 120 | 5.7 |
| Comp Example 14 | " | " | | 200 | 5.0 |
| Comp Example 15 | " | — | 2,2'-methylene bis (6-t-butyl-4-methyl phenol) | 25 | 18.0 |
| Comp Example 16 | " | — | | 90 | 16.0 |

*Decrease in surface potential after 10,000-time repetition

What is claimed is:

1. An improved electrophotographic image forming member comprising a conductive substrate having provided thereon, in sequence, a photosensitive layer comprising a charge transporting layer containing a charge transporting material and a binder, and a charge generating layer containing a charge generating material, a charge transporting material, and a binder; and a non-photosensitive layer containing a binder, wherein the improvement comprises the incorporation of an antioxidant into at least one of said charge generating layer and said non-photosensitive layer.

2. The member of claim 1 wherein said antioxidant is selected from the following groups of compounds:

Group (I): hindered phenolics;

Group (II): p-phenylenediamines;

Group (III): hydroquinones;

Group (IV): organic sulfur compounds;

Group (V): organic phosphorous compounds;

Group (VI): chromans; and

Group (VII): coumarins.

3. The member of claim 2 wherein said antioxidant is added to said charge generating layer in a ratio of 1 to 50 weight percent of said charge transporting material.

4. The member of claim 3 wherein said ratio is 5 to 25 weight percent.

5. The member of claim 4 wherein a non-photosensitive layer is provided on said charge transporting layer.

6. The member of claim 5 wherein said non-photosensitive layer contains said antioxidant.

7. The member of claim 6 wherein the ratio of said antioxidant in said non-photosensitive layer is 0.1 to 100 weight percent of the binder.

8. The member of claim 7 wherein said ratio is 1 to 50 weight percent.

9. The member of claim 5 wherein the ratio of said charge transporting material in said charge transporting layer is 30 to 150 parts by weight per 100 parts by weight of the binder.

10. The member of claim 3 wherein the ratio of said charge generating material in said charge generating layer is 20 to 200 parts by weight per 100 parts by weight of the binder.

11. The member of claim 10 wherein said ratio is 25 to 100 parts by weight.

12. The member of claim 10 wherein the ratio of said charge transporting material in the charge generating layer is 20 to 200 parts by weight per 100 parts by weight of the binder.

13. The member of claim 12 wherein said ratio is 30 to 150 parts by weight.

14. The member of claim 11 wherein said charge generating layer has a thickness of 2 to 7 μm.

15. The member of claim 13 wherein said charge transporting layer has a thickness of 5 to 30 μm.

* * * * *